US012345437B2

(12) United States Patent
Lolley

(10) Patent No.: US 12,345,437 B2
(45) Date of Patent: Jul. 1, 2025

(54) RAFTER VENT

(71) Applicant: ADVANCED BUILDING PRODUCTS, INC., Sanford, ME (US)

(72) Inventor: Keith A. Lolley, Sanford, ME (US)

(73) Assignee: Advanced Building Products, Inc., Sanford, ME (US)

( * ) Notice: Subject to any disclaimer, the term of this patent is extended or adjusted under 35 U.S.C. 154(b) by 0 days.

(21) Appl. No.: 18/776,110

(22) Filed: Jul. 17, 2024

(65) Prior Publication Data

US 2024/0369256 A1 Nov. 7, 2024

Related U.S. Application Data

(63) Continuation of application No. PCT/US2024/017682, filed on Feb. 28, 2024.

(60) Provisional application No. 63/482,565, filed on Oct. 31, 2023.

(51) Int. Cl.
*F24F 13/02* (2006.01)
*F24F 7/02* (2006.01)

(52) U.S. Cl.
CPC ..... *F24F 13/0218* (2013.01); *F24F 7/02* (2013.01); *F24F 13/0227* (2013.01); *F24F 13/0254* (2013.01)

(58) Field of Classification Search
CPC ..... F24F 7/02; F24F 13/0218; F24F 13/0227
See application file for complete search history.

(56) References Cited

U.S. PATENT DOCUMENTS

| | | | | |
|---|---|---|---|---|
| 4,977,714 | A * | 12/1990 | Gregory, Jr. | E04D 13/172 52/95 |
| 5,918,425 | A | 7/1999 | Archard et al. | |
| 6,804,922 | B1 * | 10/2004 | Egan | E04B 1/66 52/746.1 |
| 7,644,545 | B2 * | 1/2010 | Mankell | E04D 13/178 454/366 |
| 2010/0064602 | A1 * | 3/2010 | Moore | E04D 13/1625 52/95 |
| 2019/0212021 | A1 | 7/2019 | Grubka et al. | |
| 2019/0368755 | A1 * | 12/2019 | Hascher | F24F 7/02 |

OTHER PUBLICATIONS

International Search Report and Written Opinion, dated Jul. 31, 2024, received in international patent application No. PCT/US2024/017682, 8 pages.

* cited by examiner

*Primary Examiner* — Allen R. B. Schult
(74) *Attorney, Agent, or Firm* — Pierce Atwood LLP

(57) ABSTRACT

Provided herein are rafter vents including a ventilated mat extending along a roof structure, the ventilated mat comprising a plurality of entangled filaments, and a backing adhered to the ventilated mat along a surface of the ventilated mat configured to face opposite the roof structure.

20 Claims, 28 Drawing Sheets

RAFTER VENT

CROSS REFERENCE TO RELATED APPLICATIONS

This application is a continuation of International Application No. PCT/US24/17682, filed 28 Feb. 2024, which claims benefit of priority under 35 U.S.C. § 119 (e) of U.S. Provisional Application No. 63/482,565, filed on 31 Jan. 2023, entitled "Rafter Vent," the entirety of which is incorporated by reference herein.

BACKGROUND

In today's residential construction environment, there are various forms of insulation used in attic spaces. Fiberglass, extruded polystyrene (XPS), loose fill fiberglass insulation, and mineral wool, all ranging in R-values from 4-60, are common. To properly ventilate at attic space, ventilation channels need to be created to allow air entering from the outside through the soffit vent to travel up the backside of the roof decking and evacuate through the ridge vent located at the roof's ridge. Conventionally, such ventilation channels are formed from rigid polystyrene sheets.

Unfortunately, conventional ventilation channels do not reliably hold up to the forces and environmental factors to which they are exposed. For example, when new insulation products such as spray foam are installed, the polystyrene channels commonly buckle under the spray force, which leaves the air channel compromised and/or obstructed (see FIG. 2D). In addition, as shown in FIG. 2D, polystyrene is largely impermeable, which introduces a misplaced (and incomplete) local vapor barrier. Practically speaking, in each such case the conventional channel vent prevents proper drying of roof structures and insulation which, in turn, leads to moisture retention and, consequently, mold and rot.

Referring now to FIGS. 1A-1B and 2A, conditions giving rise to moisture retention in roof structures and insulation is often due to a phenomenon known as vapor drive, wherein water vapor moves through permeable materials from warmer, wetter air space to cooler, drier air space (e.g., rising from a warm interior toward the cold exterior during winter as shown) but is unable to move through vapor barriers. As such, it is typical that a dewpoint is traversed within an insulation layer, causing the water vapor to condense about the insulation itself and/or at a vapor barrier where it collects.

Still further, because conventional ventilation channels do not block or abate airflow between soffit, eave, and/or fascia vents and loose fill insulation, rapid and/or high-pressure airflow moving through a such a vent (e.g., due to wind) tends to blow loose fill insulation away from the caves of the roof. This is commonly referred to as wind washing and compromises the thermal insulation of the home. As shown in FIG. 2C, in addition to creating inefficient heating within a home, insulation loss and/or insufficient ventilation can also lead to the formation of ice dams wherein a bottom layer of snow on the roof is melted, runs down the roof to an cave or overhang and then refreezes. Over time such constant freezing and thawing causes water to back up into roofing joints intended for gravity shedding of water, thereby damaging the roof, and reducing its useful life.

These challenges are often exacerbated by cathedral and/or vaulted ceilings where sloped surfaces and space limitations often result in insufficient roof insulation, ventilation having insufficient net free area (NFA), and an imbalance in NFA between output vents such as ridge vents and intake vents such as soffit, cave, and/or fascia vents. In addition, air and moisture infiltration can occur due to permeability of finish materials (e.g., via gaps between and/or gas permeability of wood finishes such as tongue and groove, shiplap, or drywall), incomplete scaling around ceiling fixtures (e.g., ductwork, electrical boxes, lighting fixtures, wiring, HVAC, plumbing, flues, fasteners, and others) as shown in FIG. 2B, poor installation, and/or gaps due to home settling.

SUMMARY

In some embodiments rafter vents are provided including a ventilated mat constructed of entangled filaments made from a suitable material such as polypropylene, nylon six, any other material used to manufacture random entangled filament materials, or combinations thereof. Such ventilated mats can be provided in any suitable form including, for example, sheets, batts, rolls, or combinations thereof. Such ventilated mats can include surface features including, for example, dimples, channels, waffles, any other surface features, or combinations thereof and in any size and/or depth. In some embodiments, for example, ventilated mats can include a plurality of dimples ranging from one to two inches in depth. In some embodiments, ventilated mats can be sized to be placed against the underside of a roof decking and to run from an cave to a ridge of the roof. Ventilated mats can also include a bent, bendable, curved, and/or curvable portion to form an end dam at the cave for blocking airflow (e.g., wind) entering through the soffit, instead redirecting the airflow up and through vents formed by the mat. Alternatively, or in addition, the end dam can be formed from a separate piece of material engaged with the ventilated mat.

In some embodiments, the ventilated mat can also include a heat bonded filter fabric backing on one or two sides of the mat. Such a filter fabric backing advantageously permits spray foam insulation to adhere thereto without clogging or collapsing the mat. In some embodiments, the filter fabric can extend beyond the surface features along each parallel side to permit stapling and/or adhering of the mat to roof components such as, for example, rafters, roof trusses, and/or roof decks.

In one aspect, a rafter vent is provided. The rafter vent includes a ventilated mat extending along a roof structure, the ventilated mat comprising a plurality of entangled filaments. The rafter vent also includes a backing adhered to the ventilated mat along a first surface of the ventilated mat configured to face opposite the roof structure. The rafter vent also includes wherein the entangled filaments are random entangled filaments.

In some embodiments, the entangled filaments include at least one of polypropylene, nylon six, or combinations thereof. In some embodiments, the ventilated mat is at least one of a sheet of material, a roll of material, or a batt. In some embodiments, the ventilated mat includes at least one or more surface features on a second surface, opposite the first surface. In some embodiments, the surface features include at least one of dimples, channels, waffles, or combinations thereof. In some embodiments, at least a portion of the second surface having the one or more surface features is flat, the flat portion having a thickness less than a feature thickness of the one or more surface features. In some embodiments, an entire second surface of the ventilated mat, opposite the first surface, is flat. In some embodiments, the ventilated mat includes a first band comprising a first entangled filament material having a first fiber density and a second band comprising a second entangled filament material having a second fiber density less than the first fiber density. In some embodiments, the ventilated mat comprises a plurality of bands of the first entangled filament material and a plurality of bands of the second entangled filament material, the bands of the first entangled filament material and the bands of the second entangled filament material arranged in an alternating configuration along at least one of a length or a width of the ventilated mat. In some embodiments, the backing is a filter fabric.

In another aspect, a method for installing a rafter vent is provided. The method includes providing a rafter vent having a ventilated mat comprising a plurality of entangled filaments and a backing adhered to the ventilated mat along a first surface of the ventilated mat configured to face opposite a roof deck of a roof of a building structure. The method also includes attaching the rafter vent along the roof deck. The method also includes trimming the rafter vent to form an end of the rafter vent extending beyond an exterior sheathing of the roof.

In some embodiments, the method also includes attaching the end of the rafter vent to the roof deck at an end location beyond the exterior sheathing of the roof. In some embodiments, the end of the rafter vent extends one (1) to three (3) inches beyond the exterior sheathing of the roof. In some embodiments, the method also includes curving the end of the rafter vent downward onto a top of a side exterior wall of the building structure to form an integral end dam. In some embodiments, the method also includes adhering the end to the top of the side exterior wall. In some embodiments, the end of the rafter vent extends three inches (3") or more beyond the exterior sheathing of the roof. In some embodiments, the method also includes attaching one or more additional ventilated mats between the rafter vent and the roof deck. In some embodiments, the method also includes attaching an end dam to extend between the rafter vent proximate the end and a top of a side exterior wall of the building structure. In some embodiments, the step of attaching also includes bonding the backing, the ventilated mat, or both to at least one of the roof deck, a roof truss, a rafter of the roof, a joist of the roof, or a combination thereof by one or more of chemical, thermal, or mechanical bonding. In some embodiments, the backing extends beyond an edge of the ventilated mat to form at least one flap. In some embodiments, the step of attaching also includes bonding the flap to at least one of the roof deck, a roof truss, a rafter of the roof, a joist of the roof, or a combination thereof by one or more of chemical, thermal, or mechanical bonding.

In a further aspect, a method for installing a rafter vent is provided. The method includes providing first and second rafter vents, each having a ventilated mat comprising a plurality of entangled filaments and a backing adhered to the ventilated mat along a first surface of the ventilated mat configured to face opposite a roof deck of a roof of a building structure. The method also includes attaching on a first side of a roof of a building structure, at a location offset from a ridge vent of the roof, a first end of the first rafter vent. The method also includes attaching the first rafter vent along the roof deck toward and along a second side of the roof opposite the first side of the roof. The method also includes trimming the first rafter vent to form a second end of the first rafter vent, the second end extending beyond an exterior sheathing of the roof on the second side. The method also includes attaching a butt end of the second rafter vent to the roof deck on the first side of the roof at the location offset from the ridge vent of the roof, the butt end of the second rafter vent in adjacent contact with the first end of the first rafter vent. The method also includes attaching the second rafter vent along the roof deck toward and along the first side of the roof. The method also includes trimming the second rafter vent to form an exterior end of the second rafter vent, the exterior end of the second rafter vent extending beyond the exterior sheathing of the roof on the first side.

BRIEF DESCRIPTION OF THE DRAWINGS

Embodiments of the present disclosure are described by way of example with references to the accompanying drawings, which are schematic and are not intended to be drawn to scale. The drawings referenced herein form a part of the specification. Features shown in the drawings are meant to be illustrative of only some aspects of the invention.

DESCRIPTION

In the following detailed description, reference is made in the accompanying drawings, which form a part hereof. The drawings are not to scale or to proportion and the illustrated embodiments described in the detailed description and claims are not meant to be limiting. Other embodiments may be used and/or other changes may be made without departing from the spirit or scope of the present invention.

As noted above, there is a need for providing rafter ventilation capable of withstanding forces associated with high winds and blown-in or spray insulation while also preventing moisture retention within roof structures and insulation.

Figure 1A:
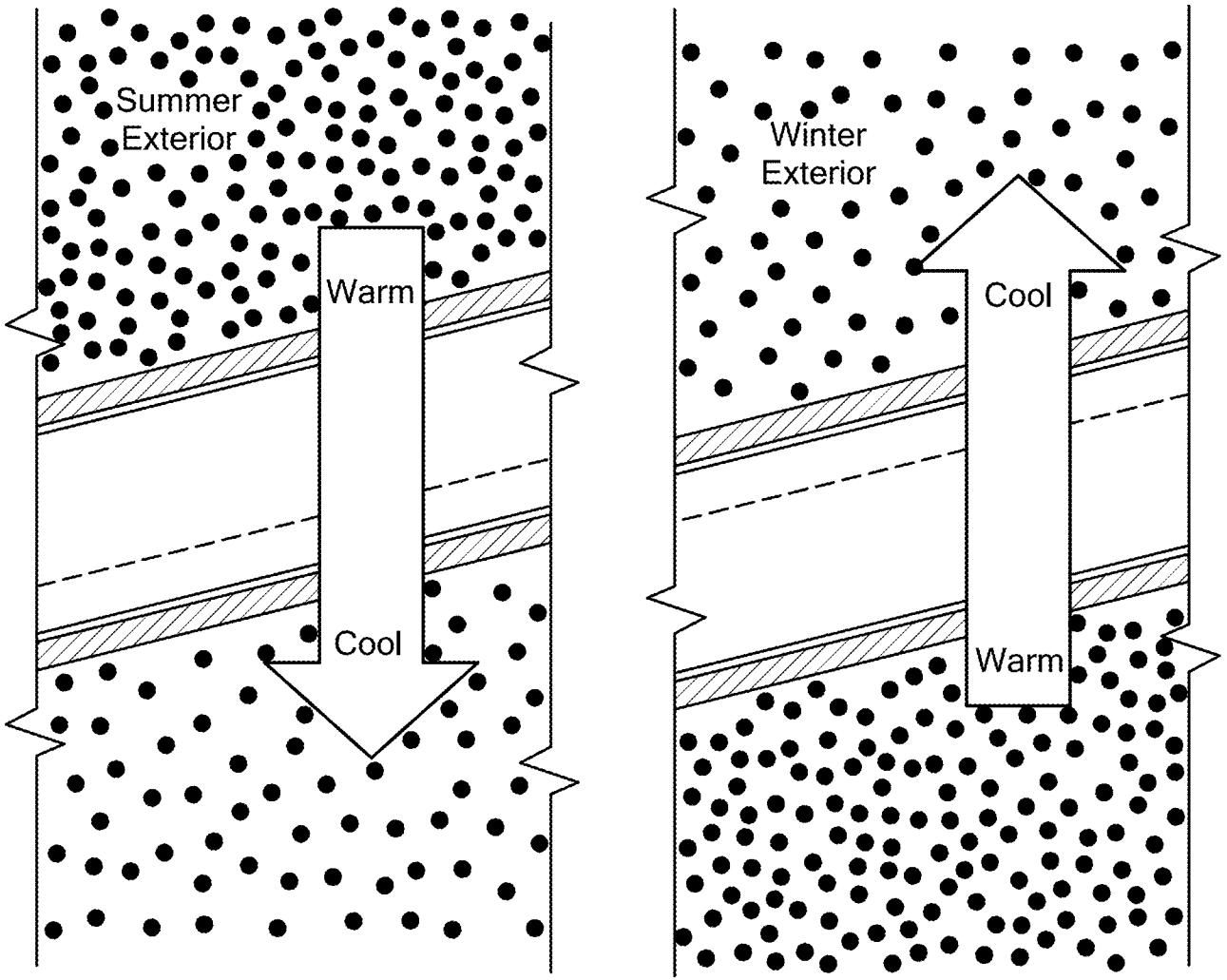
FIG. 1A PRIOR ART
FIGS. 1A-1B illustrate dew point effects within a roof according to indoor and outdoor air differentials in accordance with the prior art.
Figure 1B:
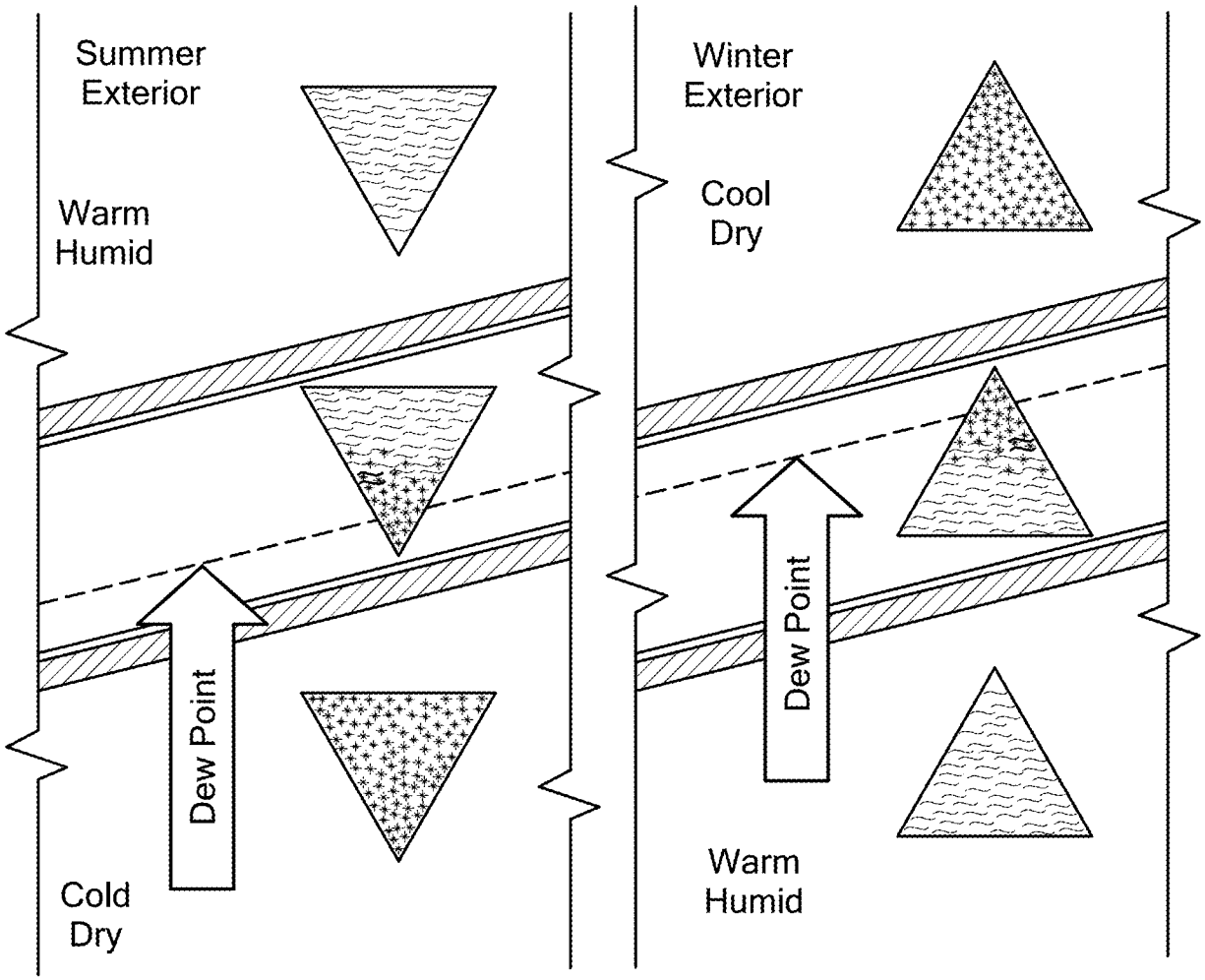
FIG. 1B PRIOR ART
Figure 2A:
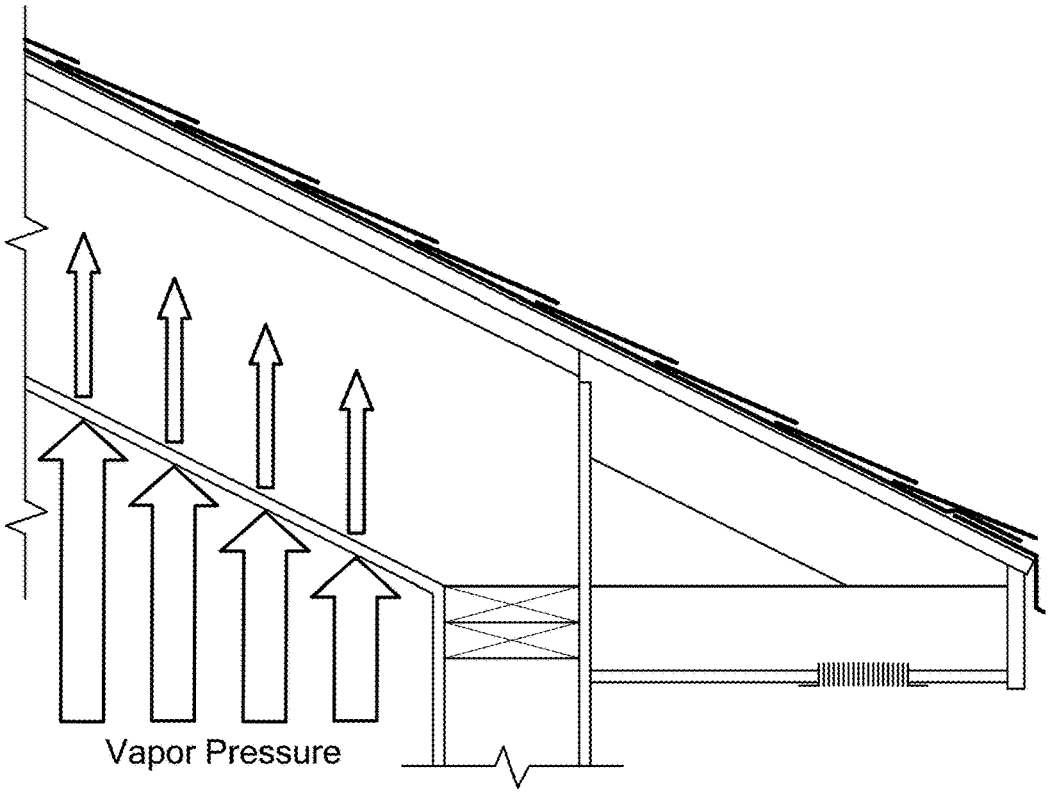
FIG. 2A PRIOR ART
FIGS. 2A-2D illustrate causes of moisture intrusion and retention within a roof in accordance with the prior art.
Figure 2B:
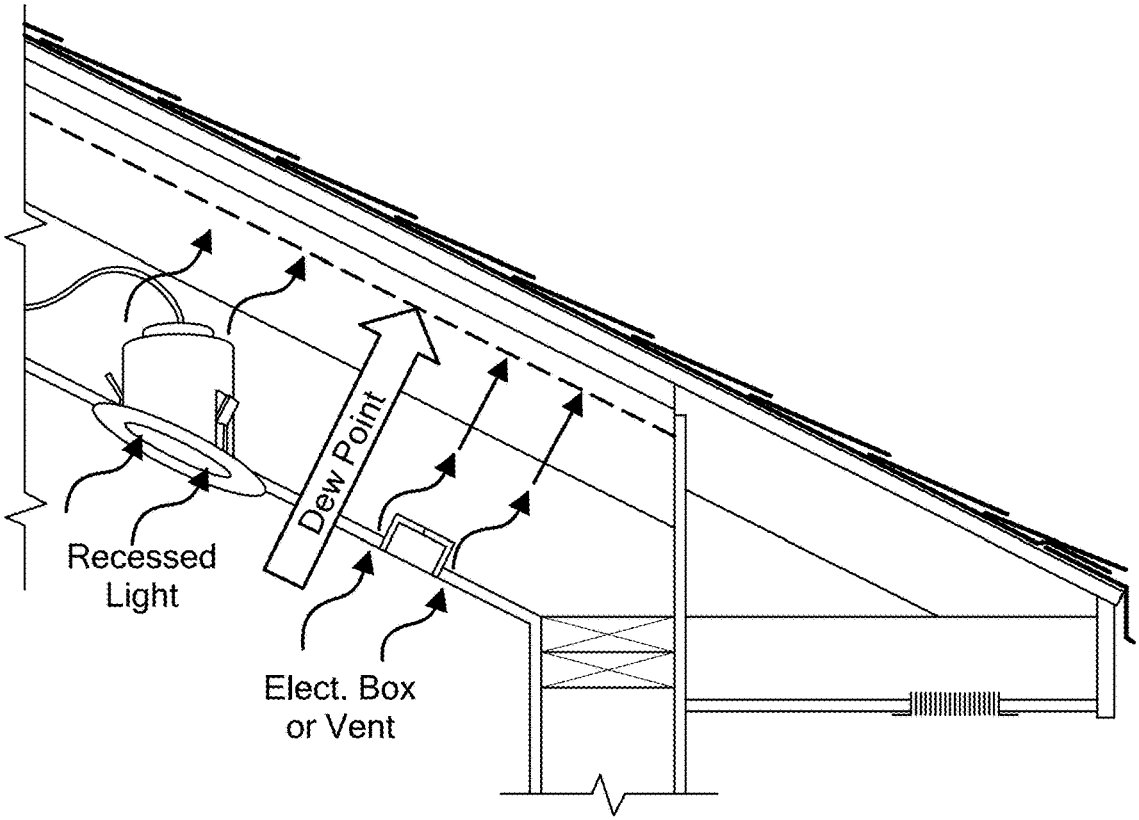
FIG. 2B PRIOR ART
Figure 2C:
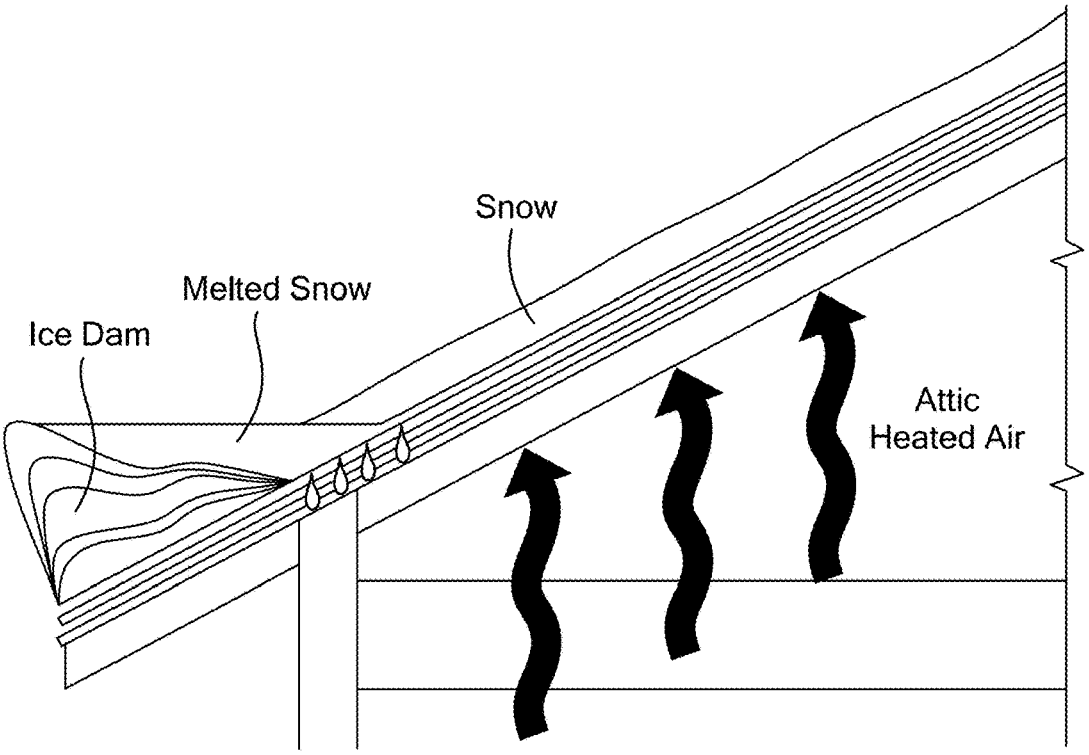
FIG. 2C PRIOR ART
Figure 2D:
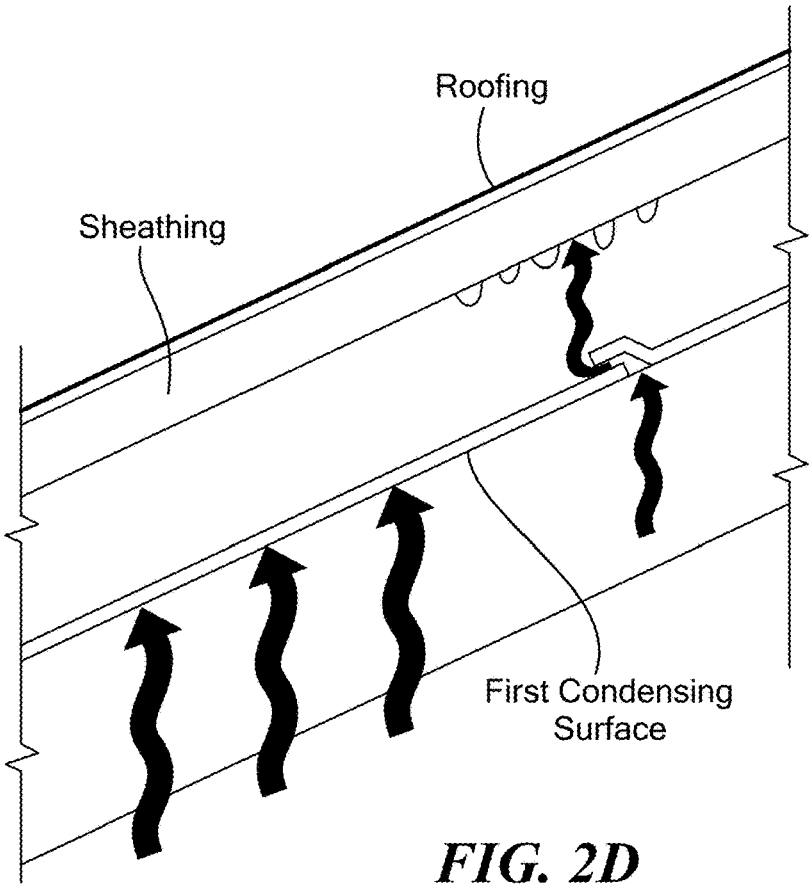
Figure 3A:
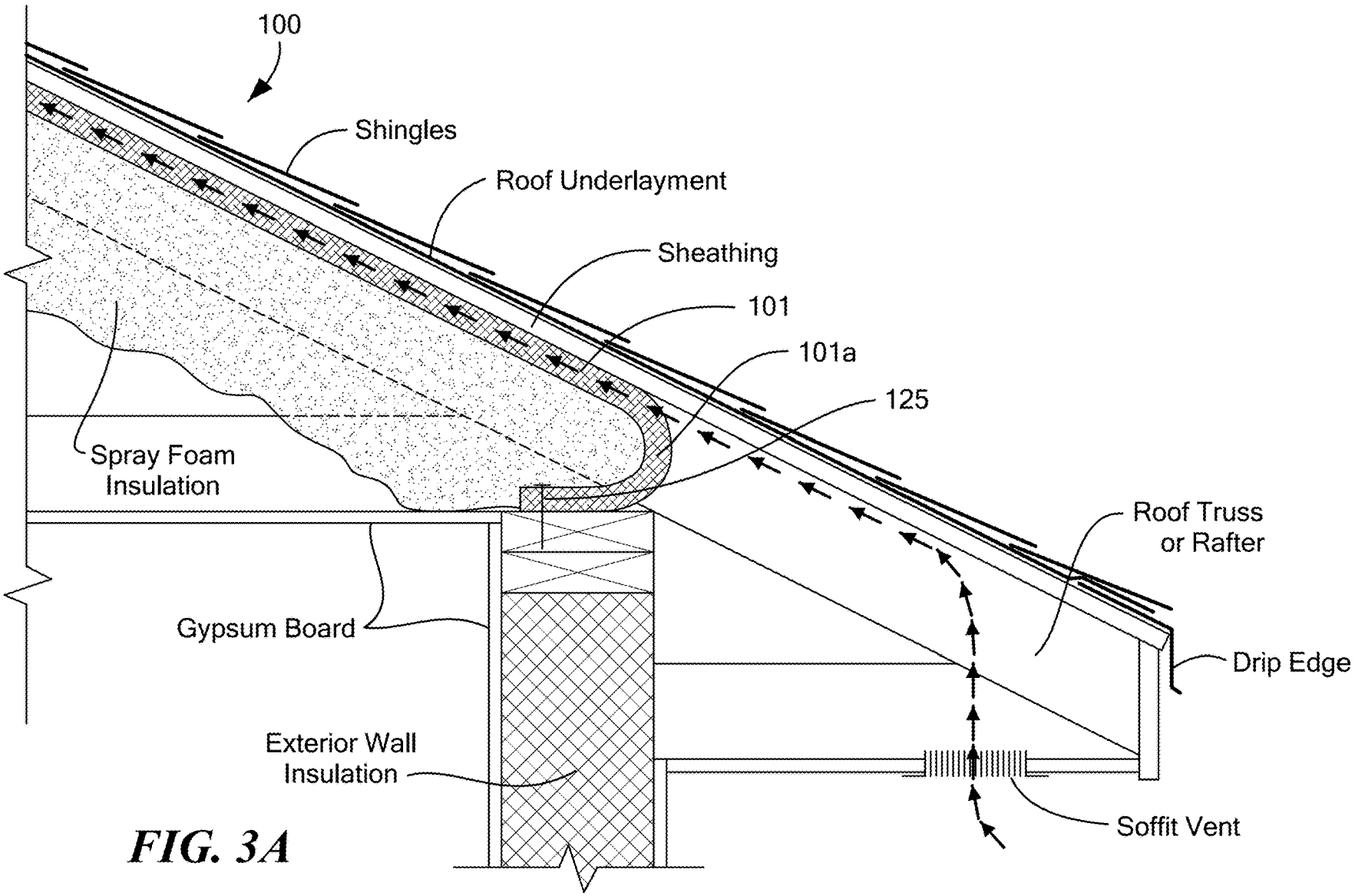
FIGS. 3A-3D illustrate cross-sectional side views of an installed rafter vent in accordance with various embodiments.
Figure 3B:
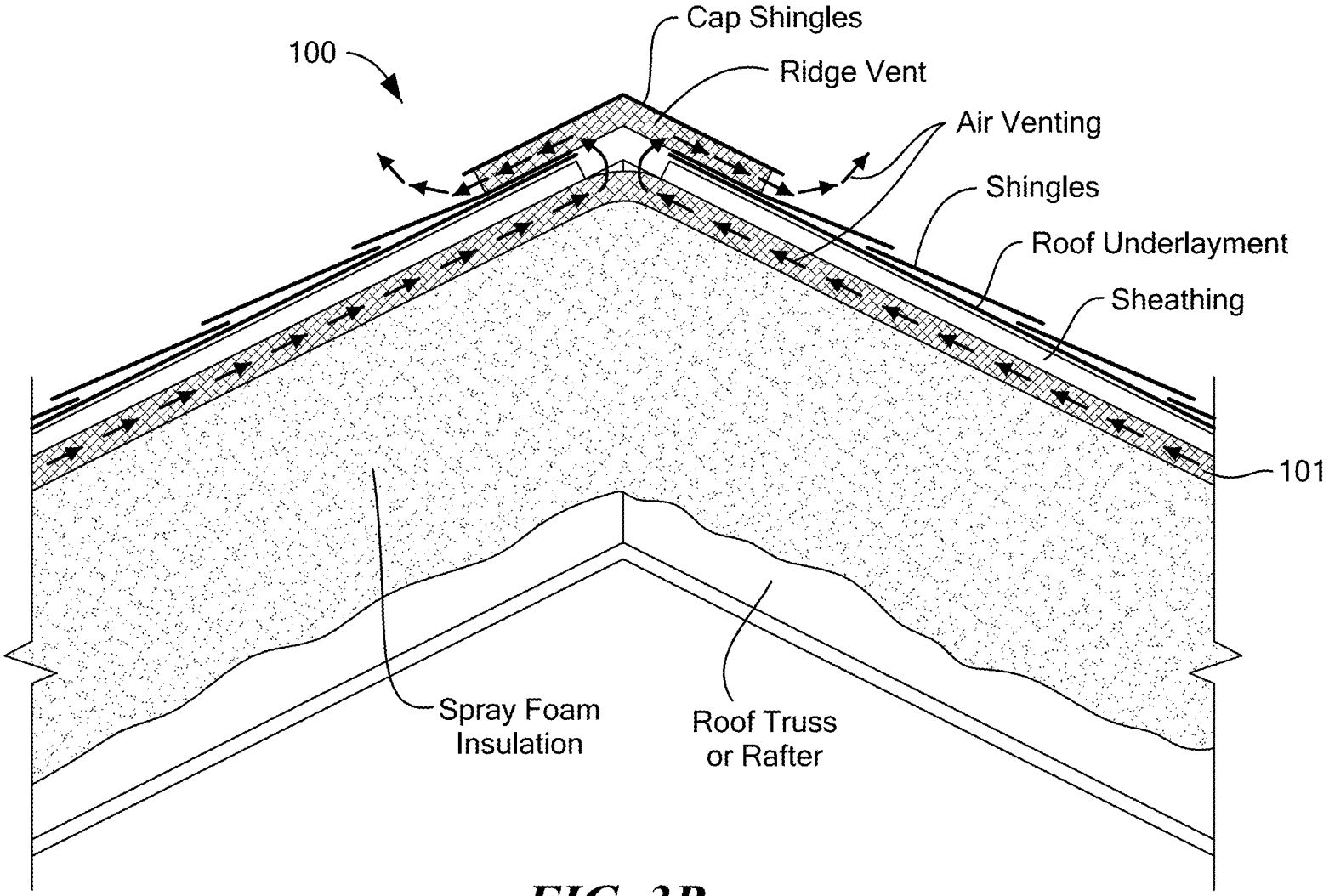
Figure 3C:
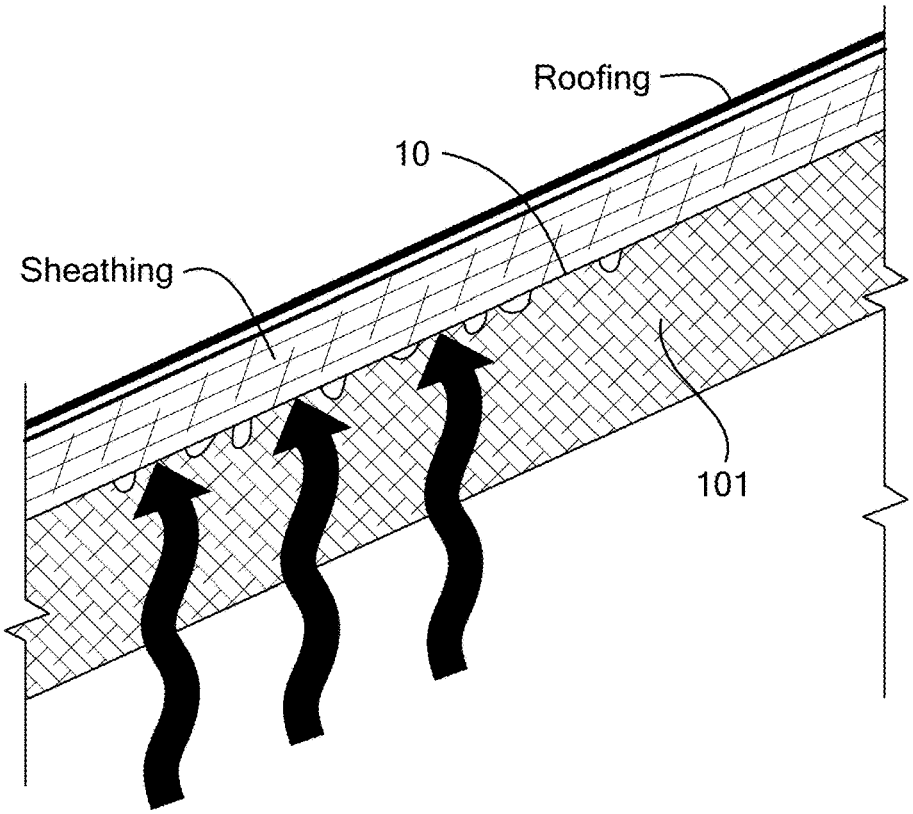
Figure 3D:
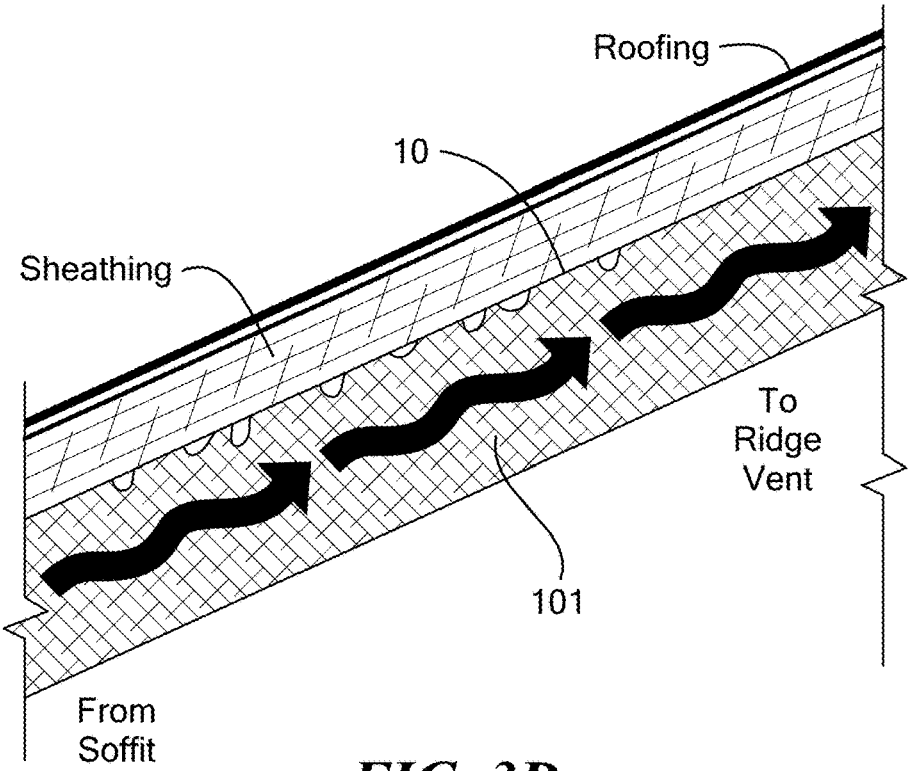
Figure 4A:
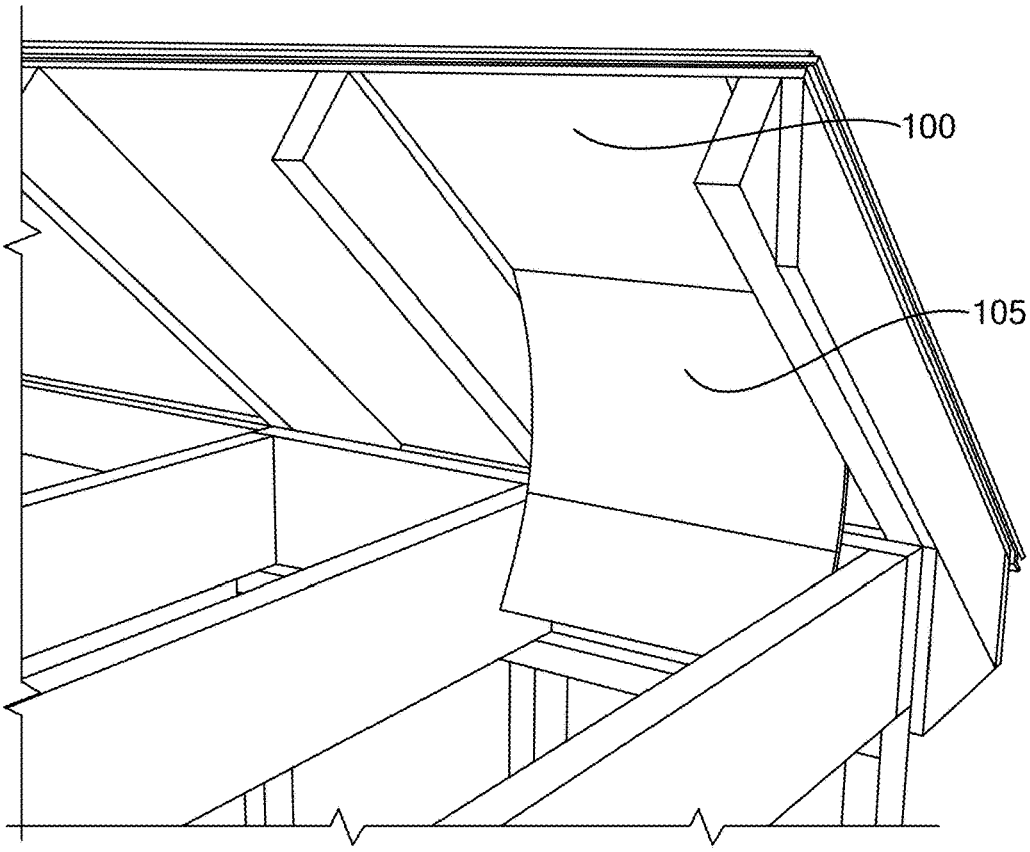
FIGS. 4A-4B illustrate interior and exterior views of an end dam of a rafter vent in accordance with various embodiments.
Figure 4B:
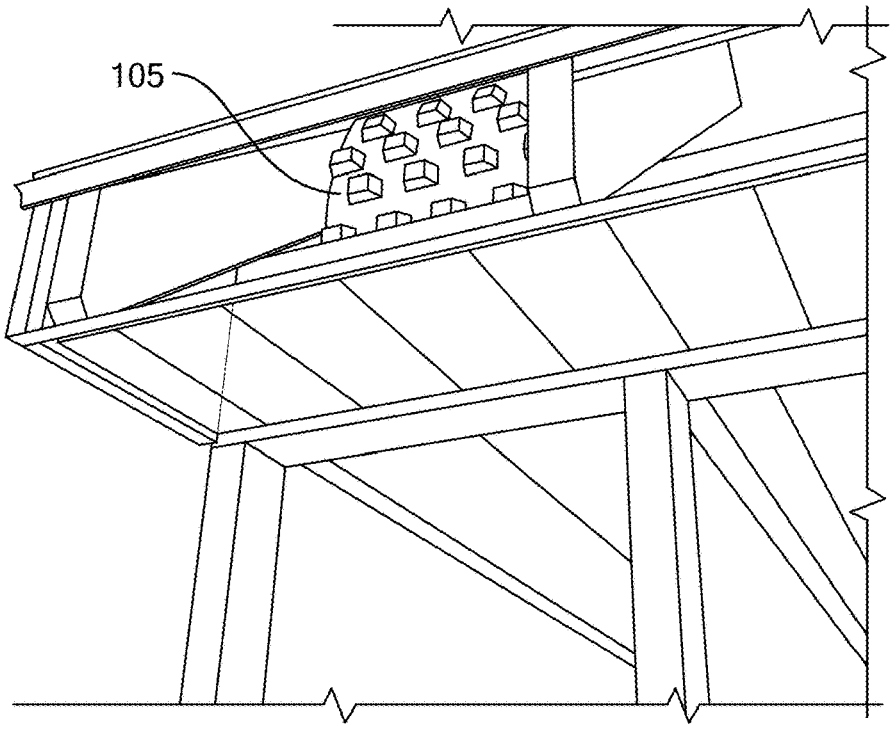

Referring now to FIGS. 3A-3D and 5A-5C, rafter vents 100 are provided herein. The rafter vents 100 can be used in connection with any roofing but may have particular utility in cathedral ceiling applications. In general, the rafter vent 100 can be applied to the interior side of roof assemblies, with particular utility in residential and light commercial construction. The rafter vent 100 permits vented airflow through a continuous open air space defined within a ventilated mat 101 of the rafter vent, thereby facilitating drying of moisture that collects within the roof (e.g., at sheathing condensing surface 10 as shown in FIGS. 3C-3D) and thus preventing deterioration to wood sheathing of the roof from condensation moisture which commonly forms in many such roofing applications.

Such rafter vents 100 can advantageously aid in compliance with International Building Code (IBC) regulation IBC 1202.1 Ventilated Attics & Rafter Spaces and International Residential Code (IRC) regulation IRC R806.2 Minimum Vent Area. In this regard, rafter vents may be satisfactory for climate zones requiring any desired minimum net free ventilation area (min. NFA), including, for example, NFA of one (1) sq. ft. for every 150 sq. ft. of attic floor space (min. NFA 1/150) as well as min. NFA 1/300.

The ventilated mats 101 can preferably be constructed of entangled filaments. In some embodiments, the ventilated mat 101, and the rafter vent 100 more generally, can advantageously be made with polymers that are stable and do not deteriorate when in contact with moisture. For example, the ventilated mat 101 can be made from materials such as polypropylene, nylon six, any other material used to manufacture random entangled filament materials, or combinations thereof. Due to the sparse nature of the entangled filaments (see the entangled filaments of the ventilated mat 601 shown in FIG. 6B), the ventilated mats 101 are highly porous such that the rafter vent 100 creates the continuous open air space between the roof structures (e.g., a roof deck, sheathing, and/or other roof structures) and roof insulation (e.g., batt insulation, spray foam insulation, loose fill fiberglass insulation, and/or other roof insulation). In some embodiments, the ventilated mat 101 can be constructed to provide continuous open air space comprising 90% or more of the rafter vent 100. However, the percentage of continuous open air space may be less than 90% and will vary depending on the configuration, surface features, and material type used in each rafter vent 100, including the ventilated mat 101.

Figure 5B:
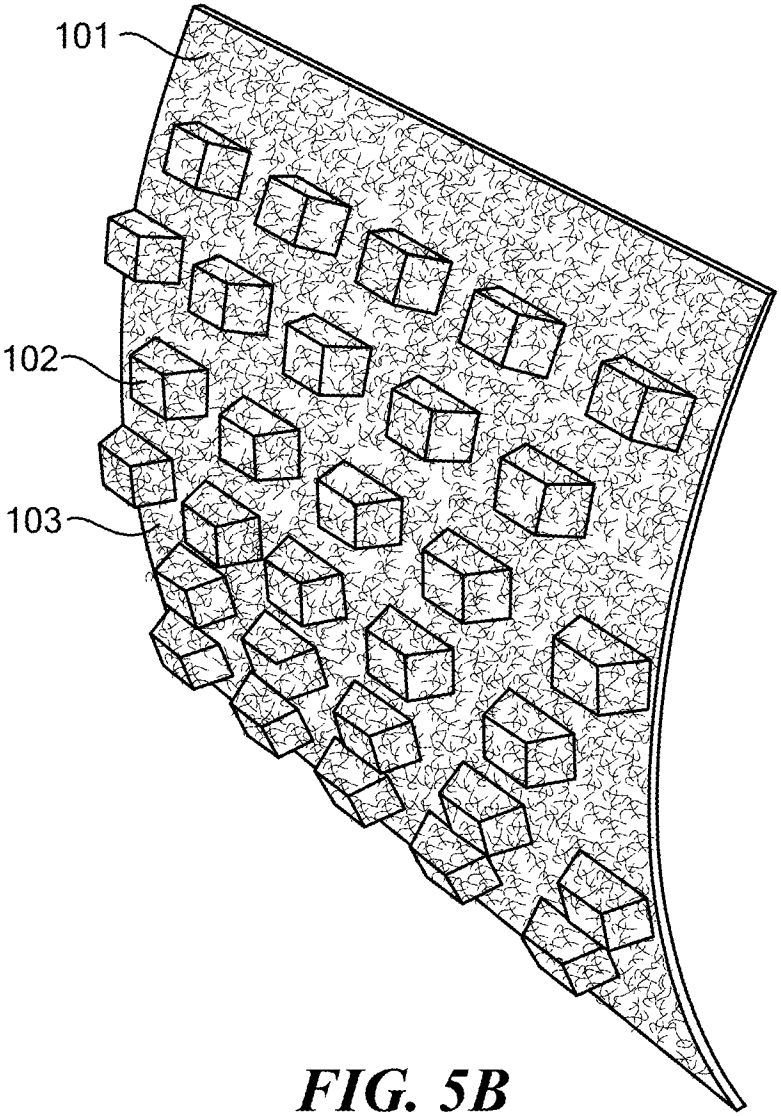
FIGS. 5A-5C illustrate back, front, and cross-sectional views of a ventilated mat having a spaced apart waffle configuration in accordance with various embodiments.
Figure 5A:
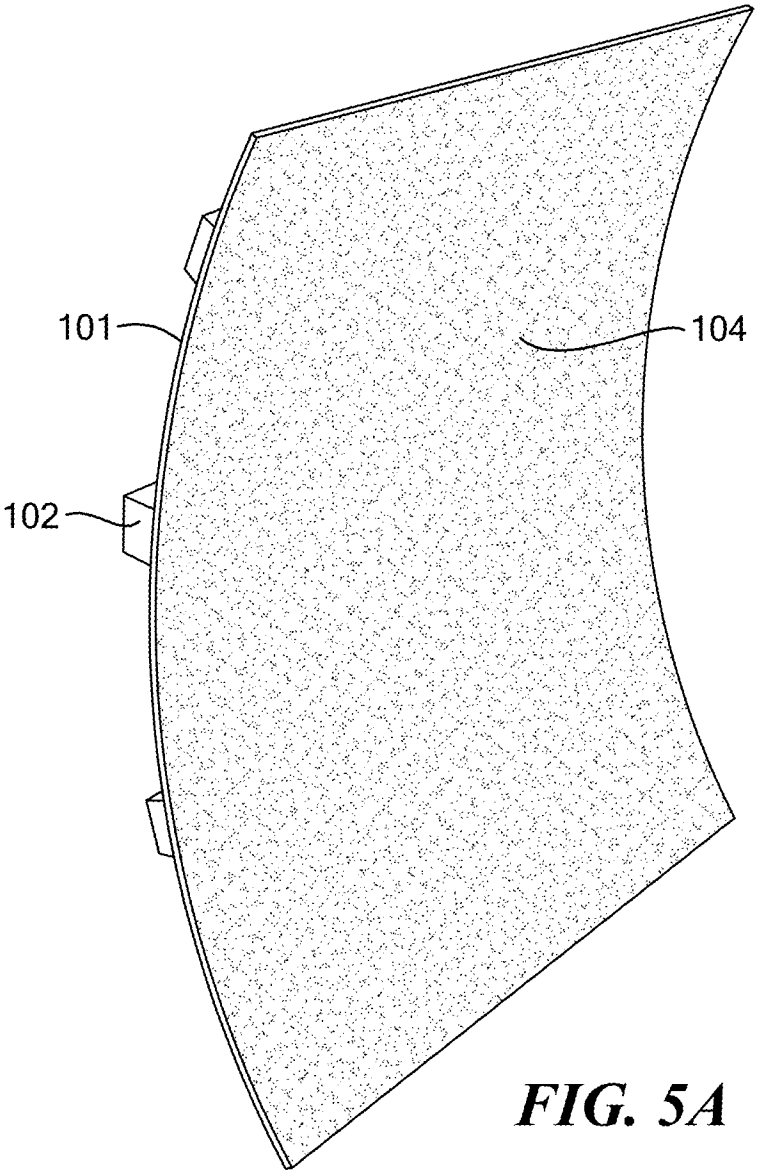
Figure 5C:
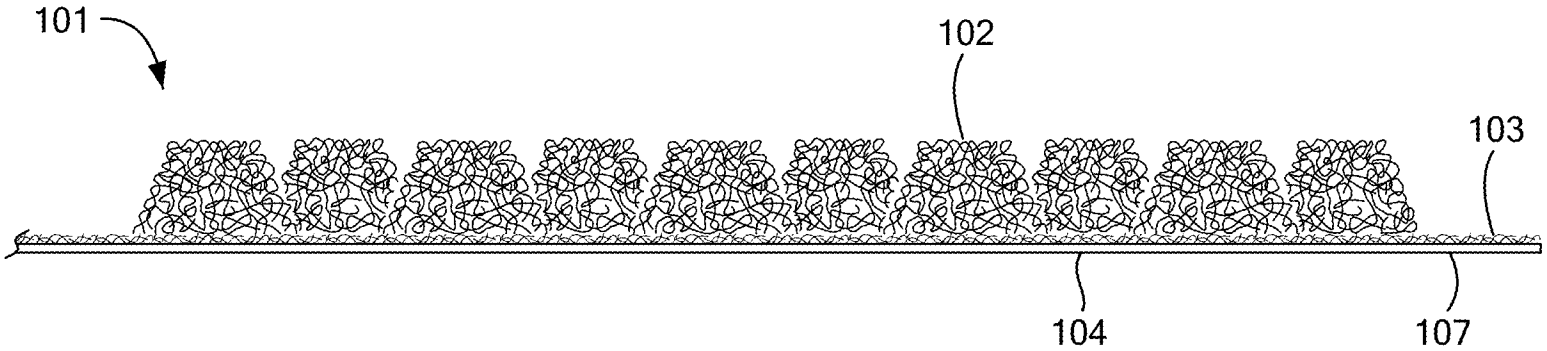
Figure 5D:
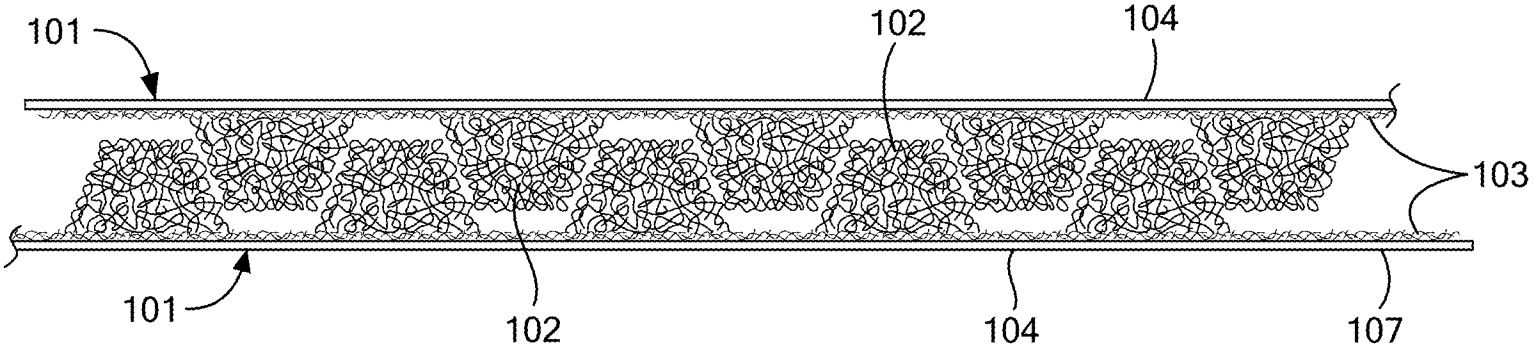
FIG. 5D illustrates a cross-sectional view of two of the vents of FIGS. 5A-5C stacked in a nested arrangement.
Figure 6A:
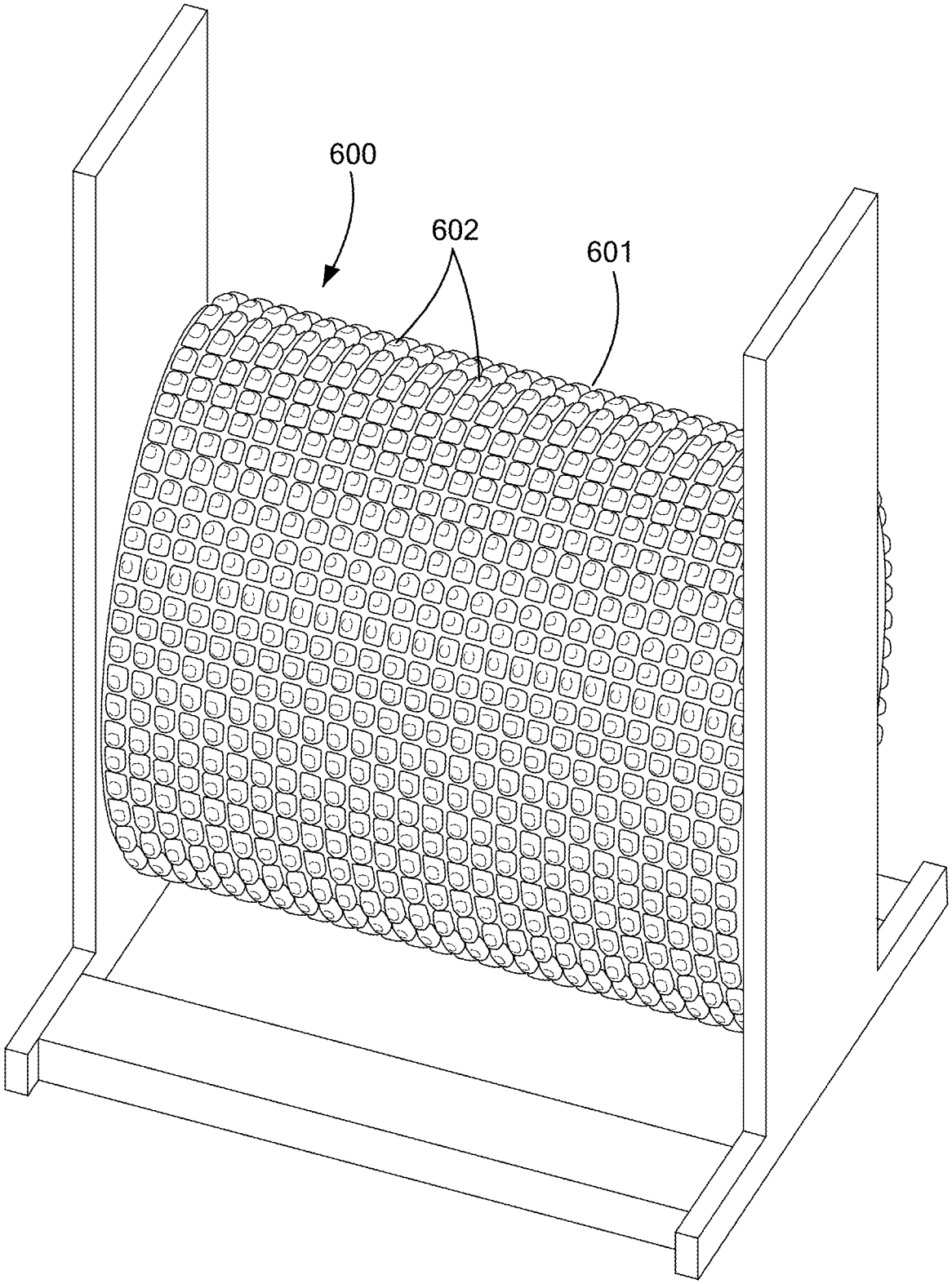
FIG. 6A illustrates a perspective view of a roll of dimpled ventilated mat material in accordance with various embodiments.
Figure 6B:
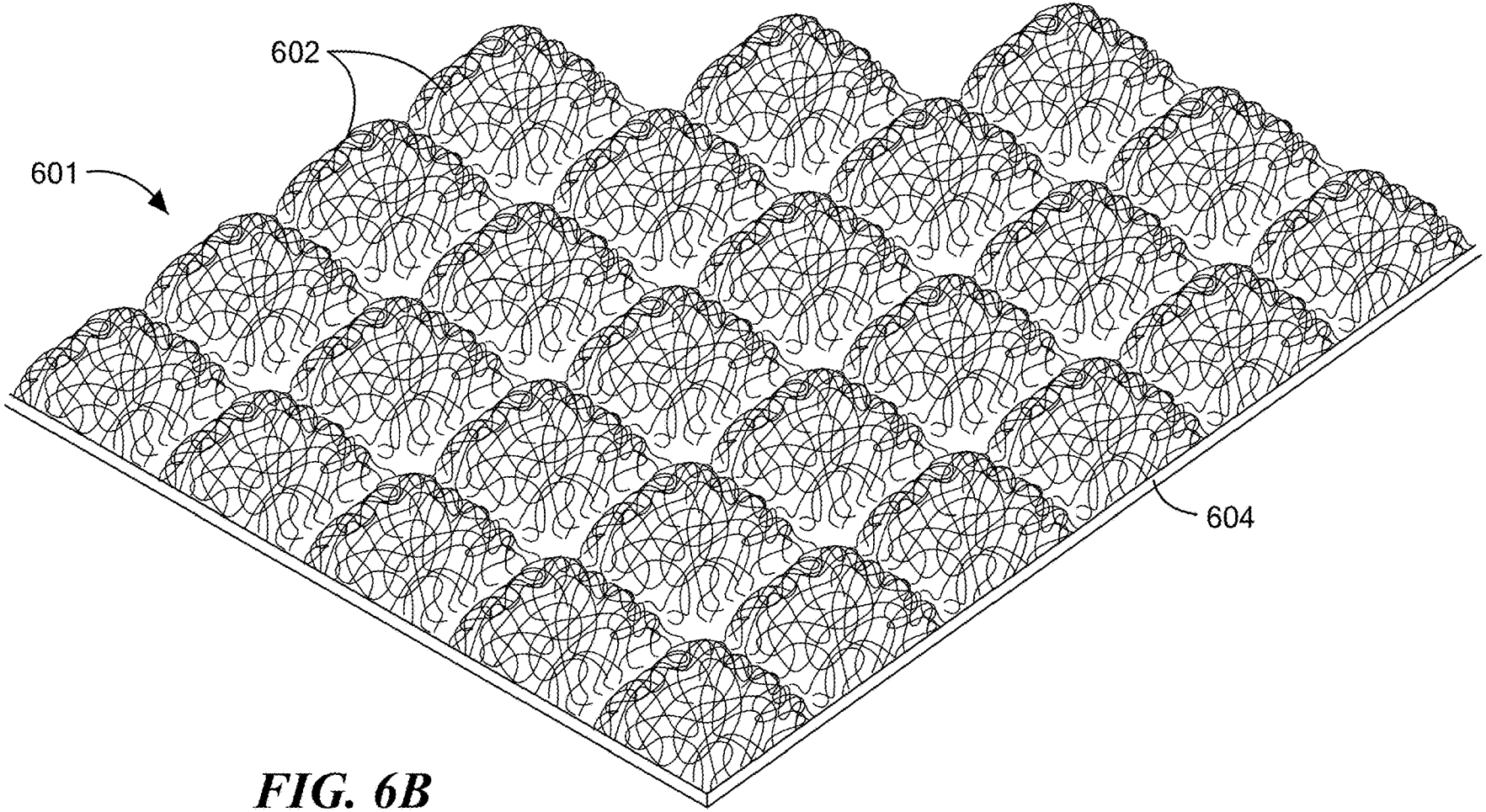
FIG. 6B illustrates an upper perspective view of the dimpled ventilated mat material of FIG. 6A in accordance with various embodiments.
Figure 7A:
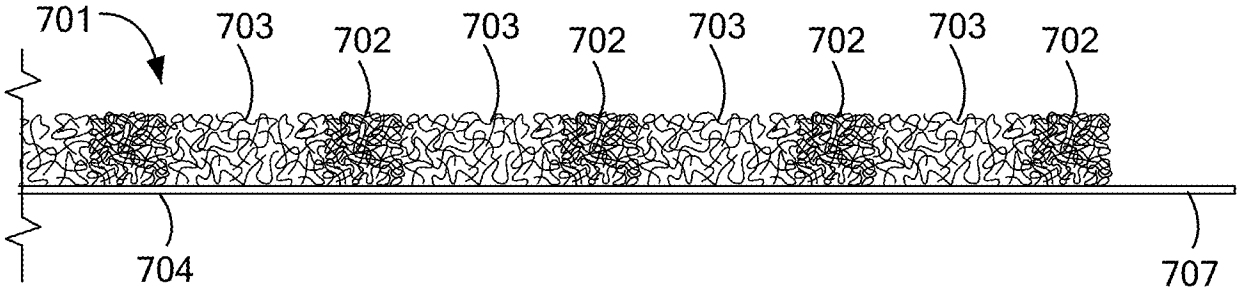
FIG. 7A illustrates a ventilated mat material including bands of varying core weight and/or density of entangled filaments.

The ventilated mats 101 can be provided in any suitable form including, for example, sheets (e.g., as shown in FIGS. 5A-5D), batts, rolls (e.g., as shown in FIG. 6A), or combinations thereof. Such ventilated mats 101 can include flat mats (e.g., completely flat ventilated mats 701 as shown in FIG. 7A or flat mat regions/bands 103, 702, 703 occupying a portion of a ventilated mat 101, 701 as shown in FIGS. 5B-5D and 7A) and/or can include one or more surface features 102 including, for example, dimples (e.g., dimples 602 as shown in FIGS. 6A-6B), channels, waffles (e.g., waffles 102 as shown in FIGS. 5A-5D), any other surface features, or combinations thereof. The overall ventilated mat 101 can be provided in any size, thickness, and/or configuration. For example, the rafter vent 100 can vary in thickness from three-eighths inches up to two inches based on the application, although in some embodiments thinner or thicker rafter vents 100 can be used.

In addition, individual surface features can be provided having any shape, size, and/or depth/thickness. In some embodiments, the size, shape, and depth/thickness of such surface features and/or the ventilated mat 101 can advantageously be configured to balance continuous open air space and compression resistance such that the ventilated mat 101 can permit sufficient vented airflow to prevent moisture retention while remaining strong and stiff enough to resist obstruction due to compression from, for example, spray foam insulation and/or high airflow (e.g., from high winds).

In some embodiments, the individual surface features (e.g., waffles 102 shown in FIG. 5C) can be spaced apart with flat mat regions 103 extending therebetween. In this manner, the flat mat regions 103 can provide additional continuous open air space while the raised waffle features 102 provide some continuous open air space and also compression resistance. Such configurations can also advantageously be configured such that the flat mat regions 103 are sized to accommodate the surface features of a similar ventilation mat, thereby permitting space-saving nesting storage. As shown, for example, in FIGS. 6A-6B, in some embodiments each ventilation mat 601 can include a plurality of dimples 602 ranging from one to two inches in depth.

As discussed in connection with exemplary installation methodologies below, in some embodiments the ventilation mat 101 can be sized to be placed against the underside of a roof decking and to run from an cave to a ridge of the roof. The mat 101 can also include a bent, bendable, curved, and/or curvable portion to form an integral end dam 101*a* at the cave for blocking airflow (e.g., wind) entering through the soffit, instead redirecting the airflow up and through vents formed by the mat 101. Alternatively, or in addition, in some embodiments, a separate end dam 105 can be formed from a separate piece of material and bonded to or engaged with the ventilated mat 101 to provide similar functionality to the integral end dam 101*a*.

As shown in FIGS. 5C and 7A, in some embodiments, the ventilation mat 101, 701 can also include backing layer 104, 704 bonded to one or both sides of the ventilated mat 101, 701. The backing layer 104, 704, can be constructed of any suitable material including, for example, filter fabrics, which can be bonded to the ventilated mat 101, 701 by any suitable means, including, for example, heat bonding, chemical bonding, mechanical entanglement, or any other suitable means. The backing layer can advantageously permit spray foam insulation to adhere thereto without clogging or collapsing the ventilated mat 101, 701 itself. In other words, a filter fabric backing 104, 704, positioned on the interior side of the ventilated mat 101, 701, can advantageously assure a clear vented path free of insulation intrusion, even after being subjected to potentially high-pressure impacts from small spray-in insulation fibers and/or particles during the installation of such spray-in insulation. As such, the rafter vents disclosed herein can provide clear air space from the soffit to the ridge due to the backing material (e.g., heat bonded filter fabric) acting as a shield during spray foam applications, including the spray foam applications used in the construction industry. Furthermore, the backing material 104, 704 can advantageously function as a strong bonding surface for the spray foam insulation to adhere to after the spray foam is applied (e.g., where the spray foam particles partially intrude into the backing material 104, 704 to provide mechanical bonding, without substantially intruding into the continuous air space of the ventilated mat 101, 701).

Figure 7B:
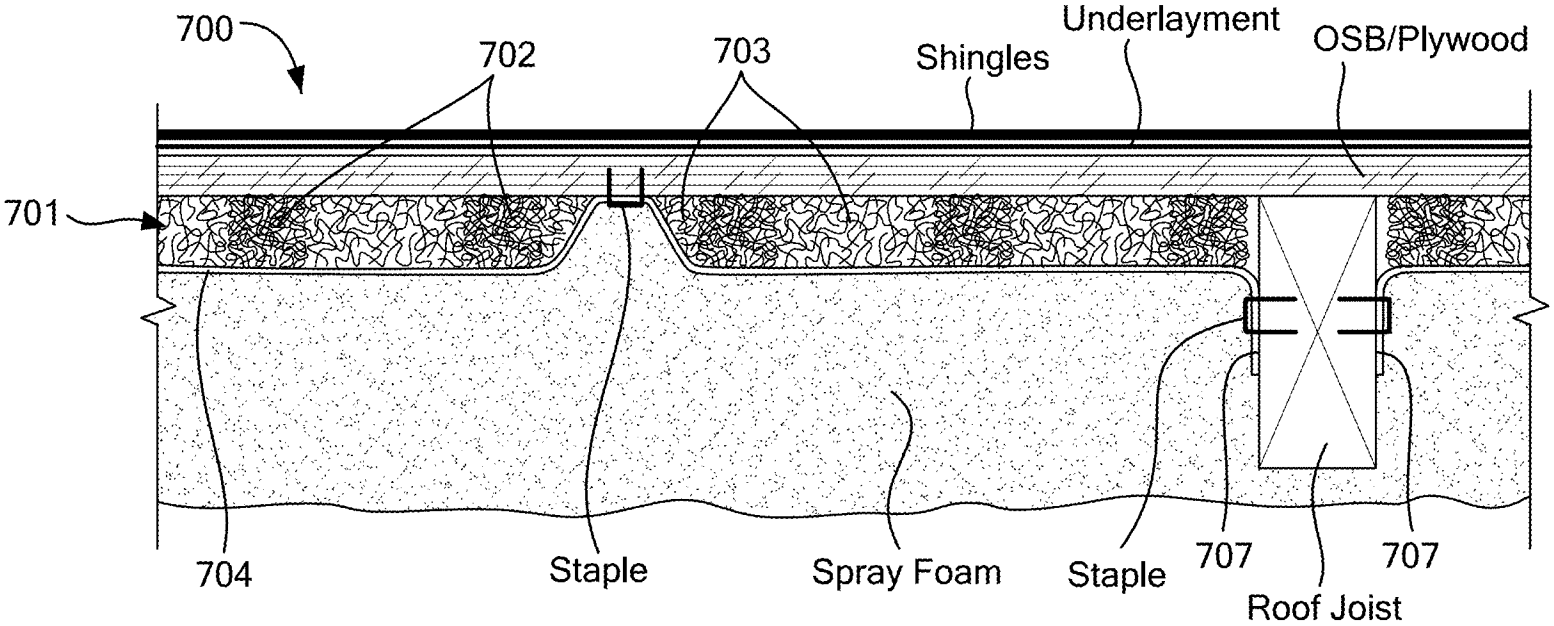
FIG. 7B illustrates a rafter vent including the ventilated mat material of FIG. 7A as installed in a roof.
Figure 8A:
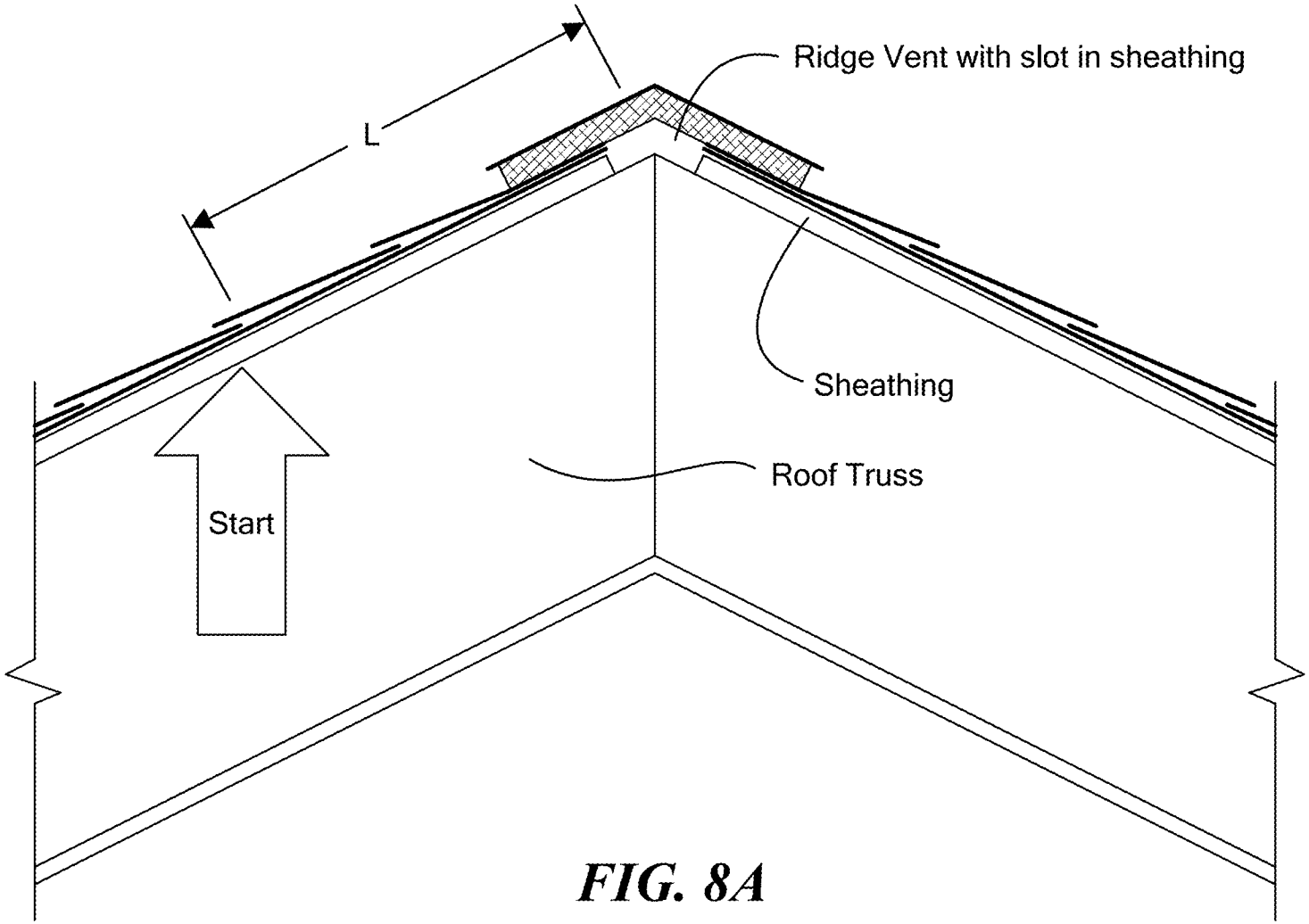
FIGS. 8A-8I illustrate method steps for installing a rafter vent in a roof for use with batt insulation in accordance with various embodiments.
Figure 8B:
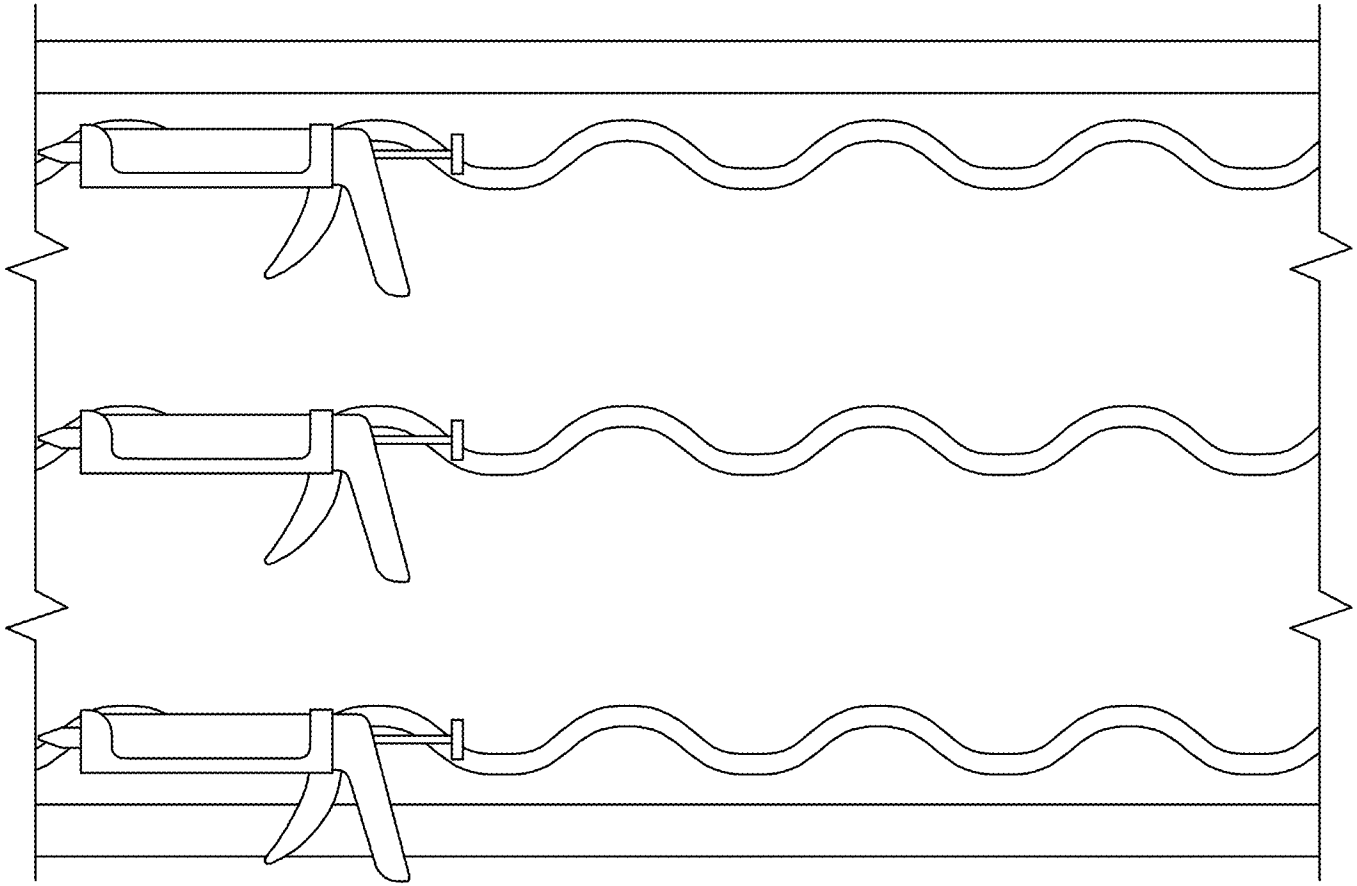
Figure 8C:
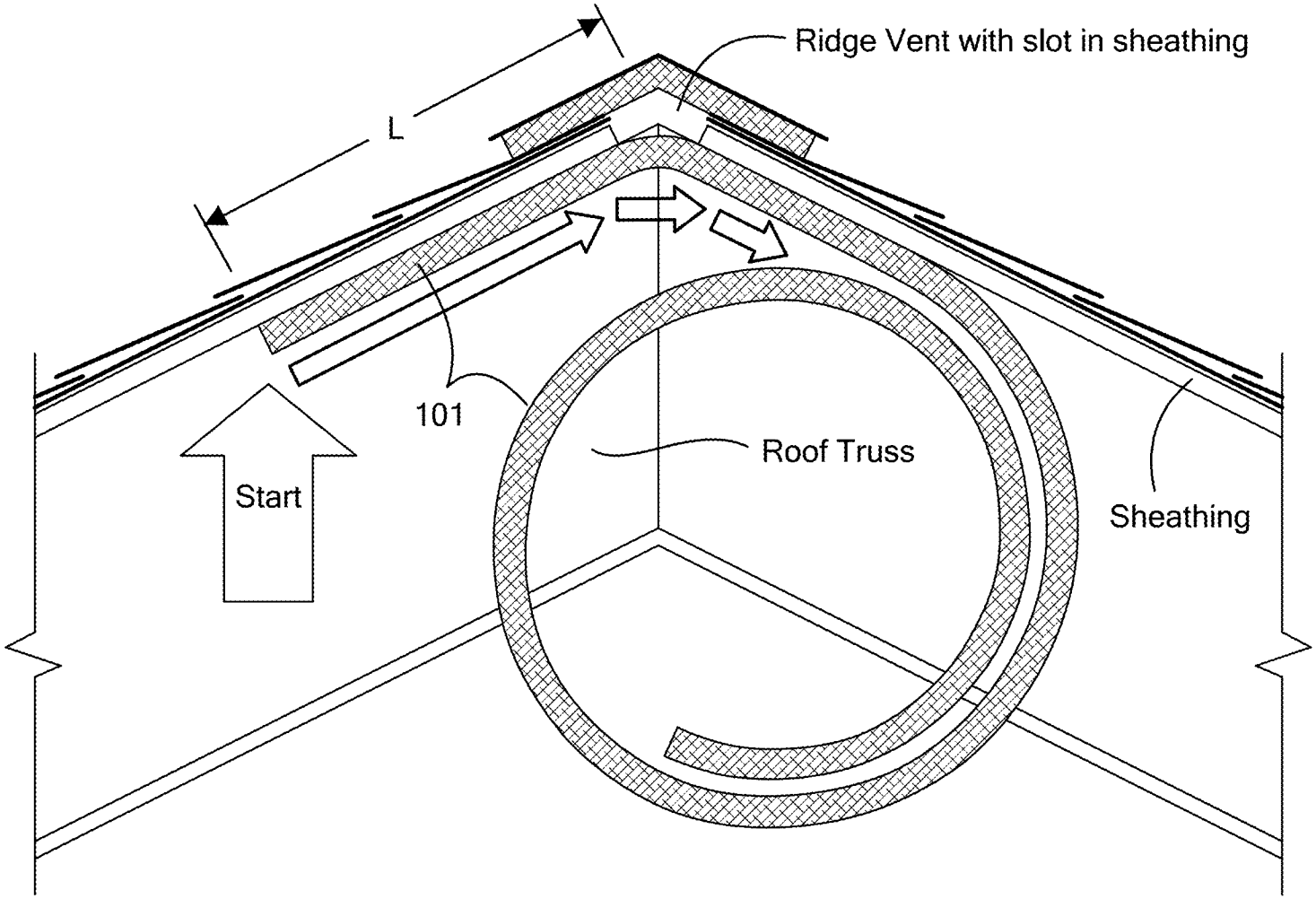
Figure 8D:
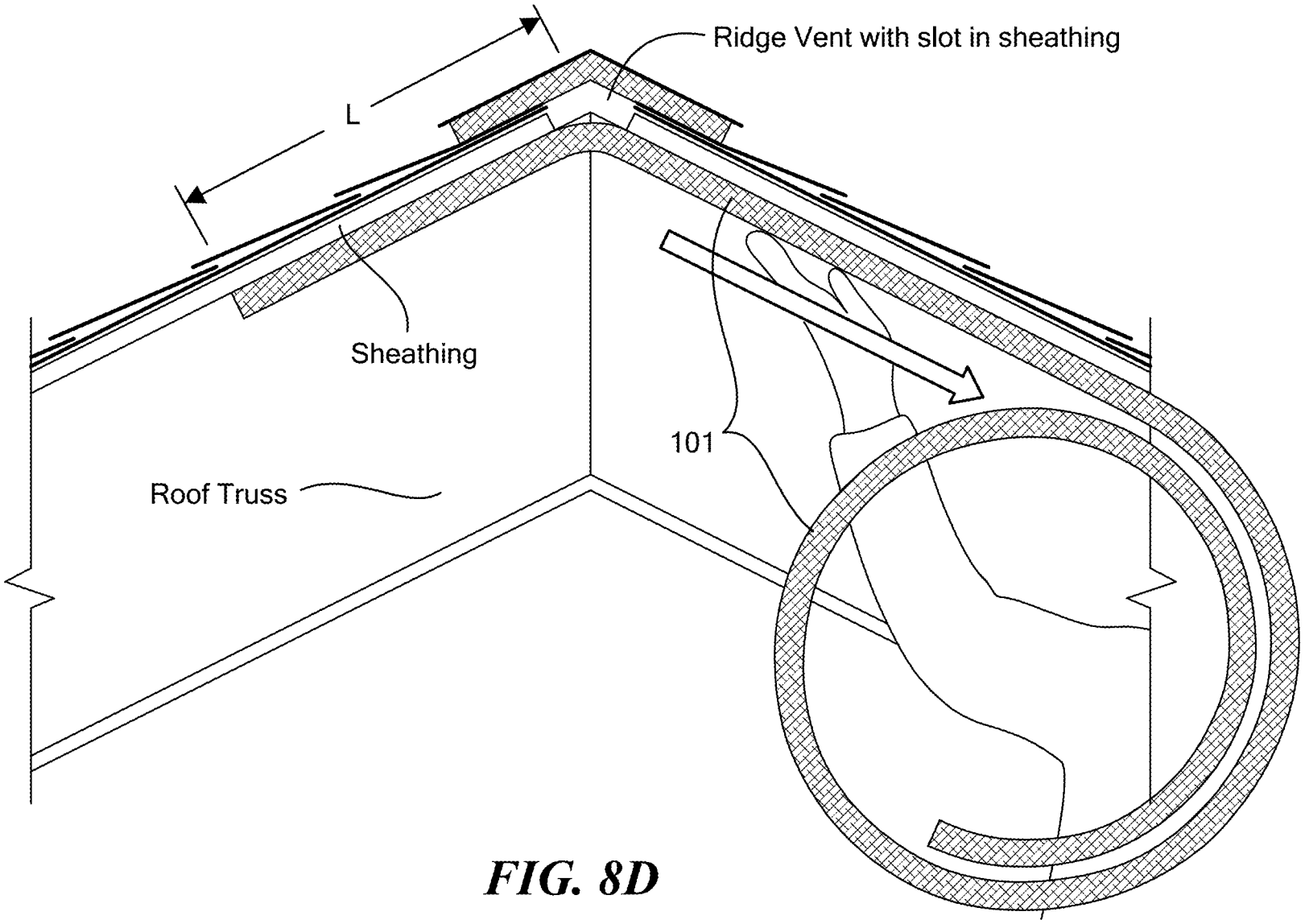
Figure 8E:
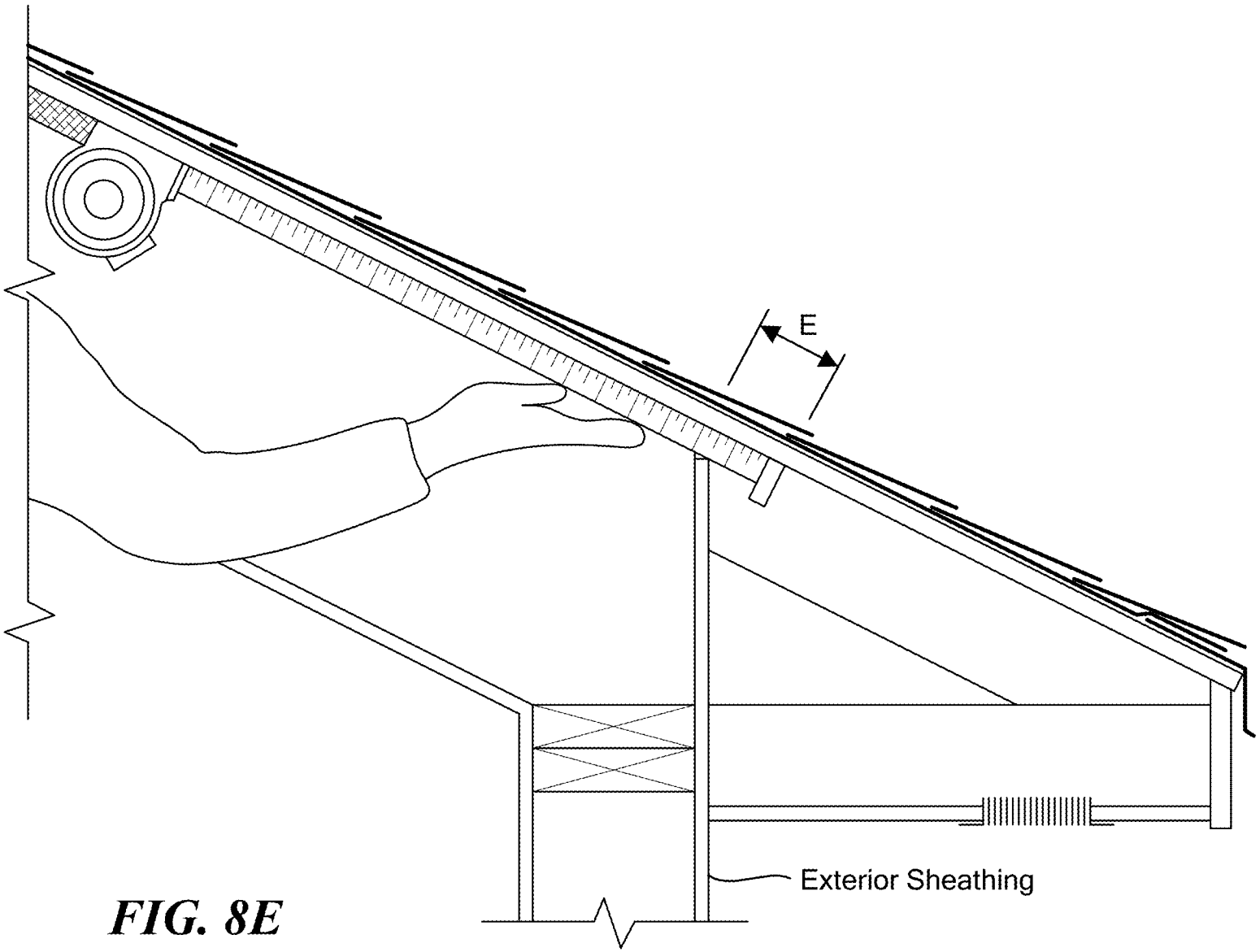
Figure 8F:
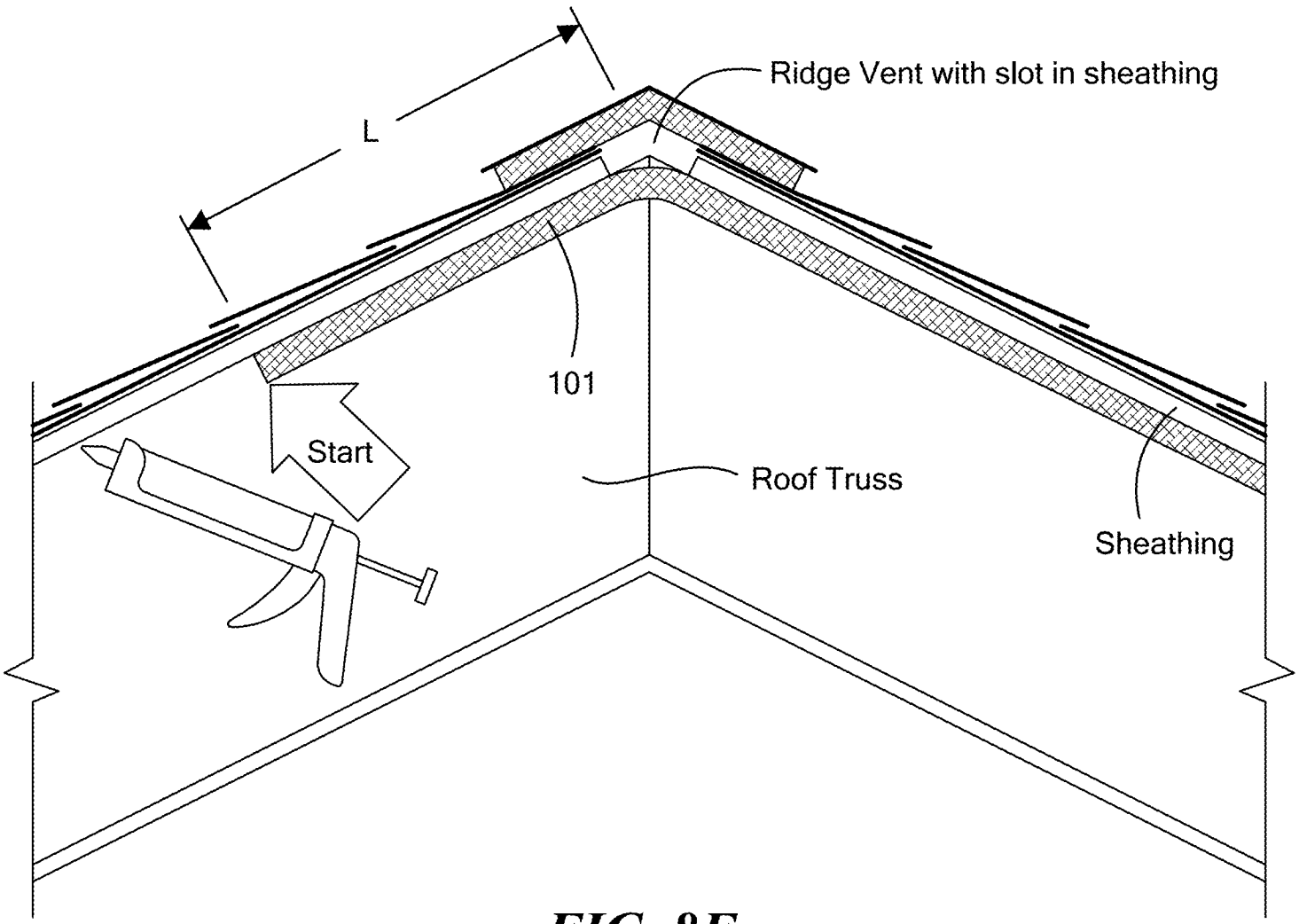
Figure 8G:
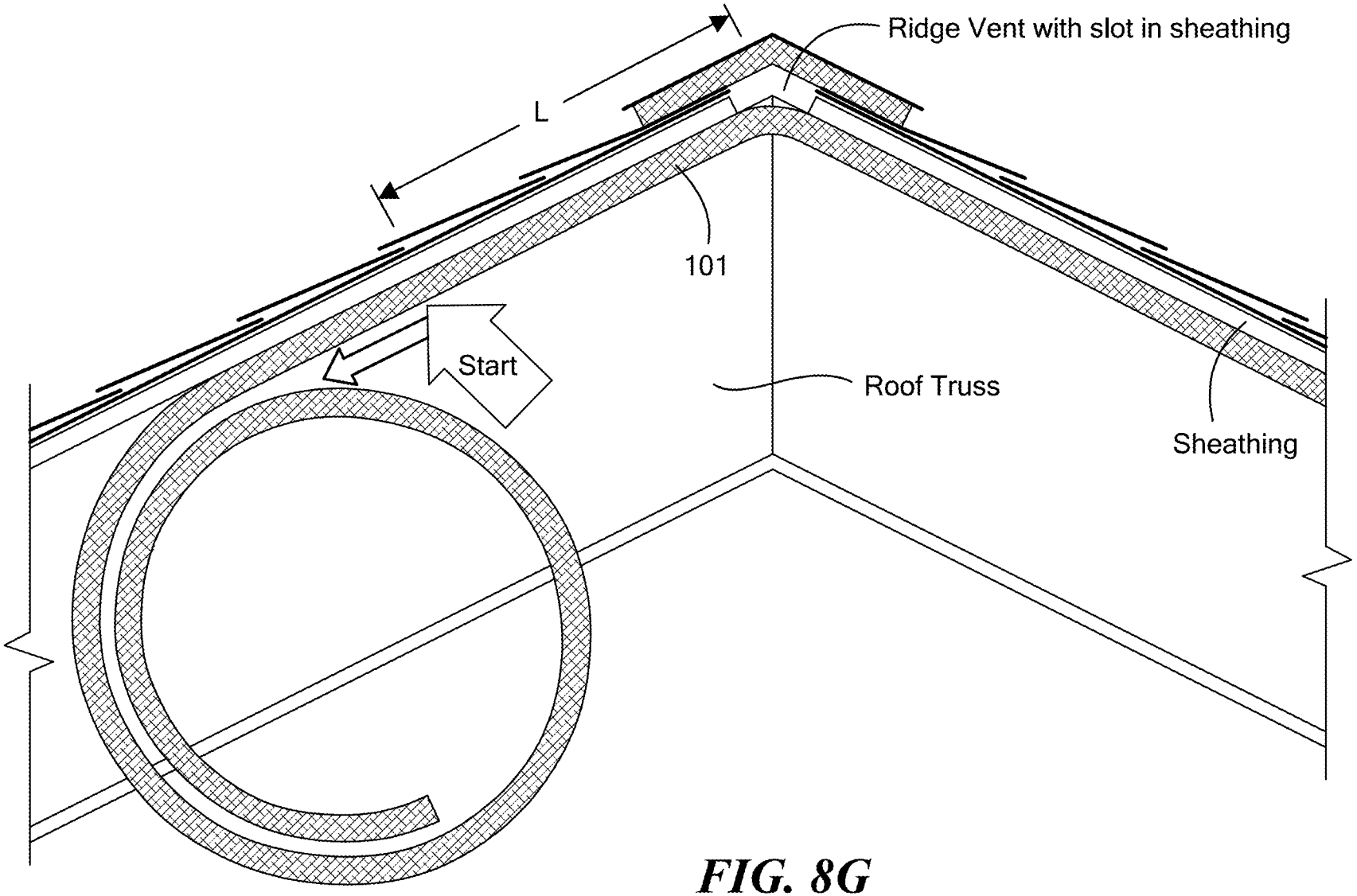
Figure 8H:
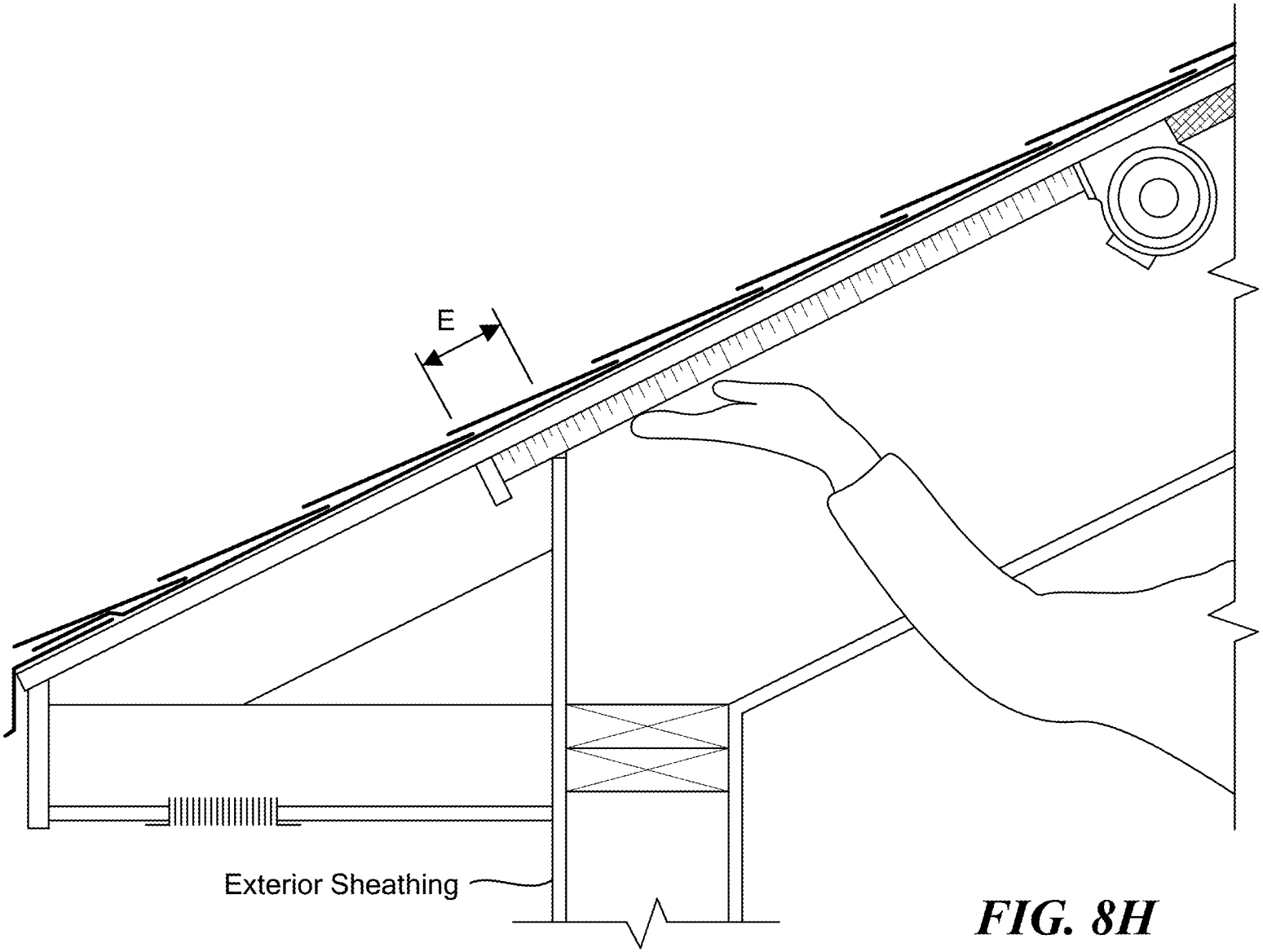
Figure 8I:
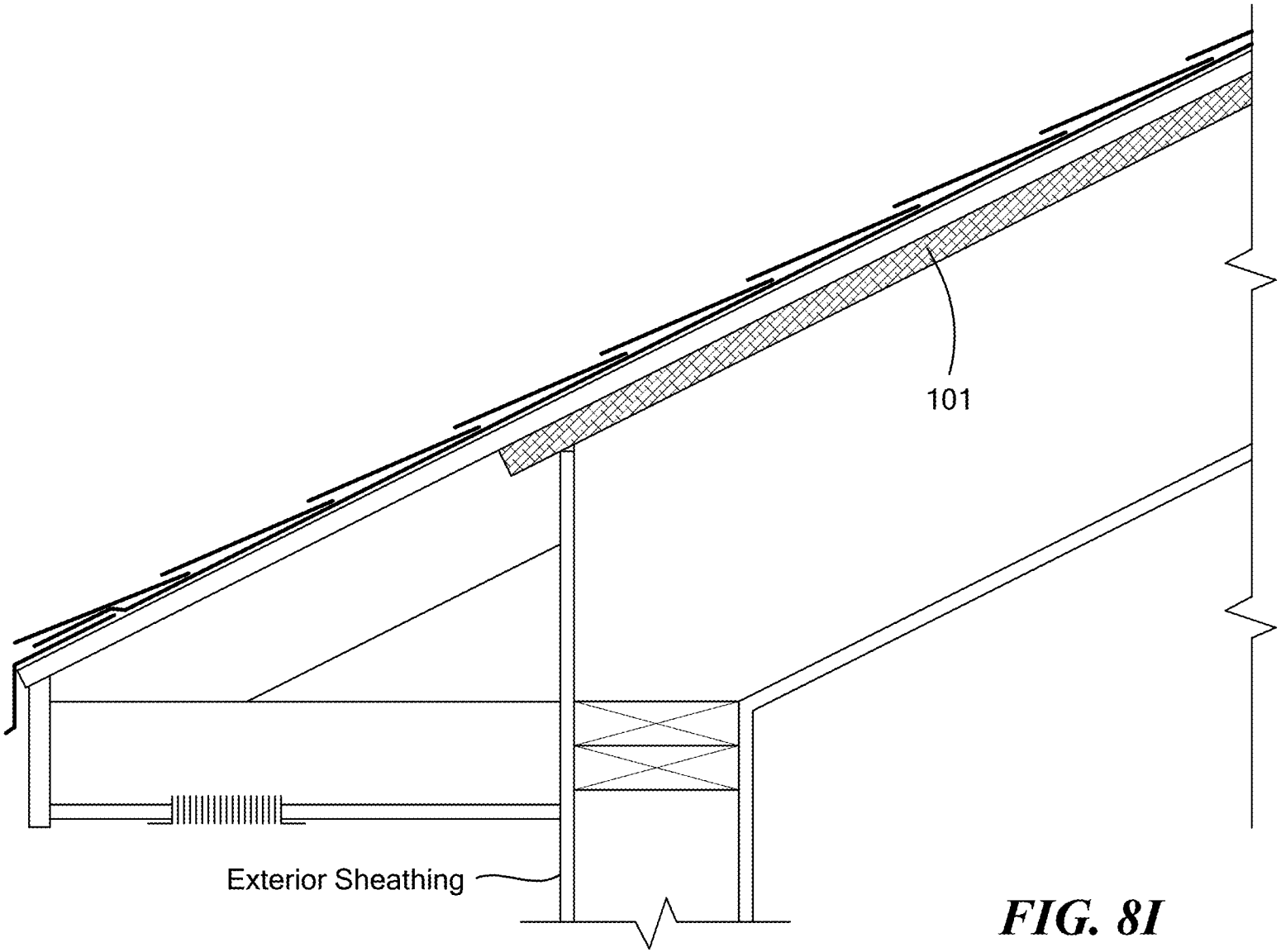

In some embodiments, as shown, for example, in FIG. 5C and FIGS. 7A-7B, the backing 104, 704 fabric can extend beyond the surface features 102 and/or flat mat regions/bands 103, 702, 703 along each parallel side to form one or more flaps 107, 707. The flaps 107, 707 can permit at least one of mechanical, chemical, or thermal attachment of the ventilated mat 101, 701 to roof components such as, for example, rafters, roof trusses, and/or roof decks.

Such backing 104, 704 may be of particular utility in cathedral ceiling applications. In many cases, cathedral ceilings use one or more of 2x joists, parallel chord trusses, and/or engineered wood I-joists. These configurations may result in limited joist depth and thus, in cathedral ceilings, the insulation amount and therefore R Value may be limited by the joint depth. However, in such applications, for thicker insulation directly under the roof deck, spray foam can be desirable, particularly for open web trusses, as the spray foam can generally have a somewhat higher R-value per depth and can, in some cases, extend slightly thicker than the baseline joist depth. Thus, resistance of the rafter vent 100 to spray-in foam insulation can advantageously permit better insulation in such applications.

In some embodiments, rafter vents 100 can be produced with and/or without a backing 104. Such unbacked rafter vents can, in some applications, include the unbacked ventilated mat 101 and can be installed between a rafter vent 100 having a backing 104 and the roof deck to make the ventilated air space thicker (e.g., twice as thick) to increase continuous open air space in some applications. Such unbacked rafter vents can also be used in connection with ceilings where separation fabric is not needed such as, for example, ceilings where spray-in insulation will not be used.

As shown, for example, in FIGS. 6A-6B, in some embodiments each ventilation mat 601 can include a plurality of dimples 602 ranging from one to two inches in depth. In particular, the prototype rafter vent 600 shown in FIGS. 6A-6B is constructed from a core material for the dimpled ventilated mat 601 of polypropylene having a core weight of ASTM D5261 20.0 oz/sq yd, a fabric backing material 604 of polyester having a fabric weight of ASTM D5261 2.9 oz/sq yd, and the rafter vent 600 having a total weight of ASTM D5261 22.9 oz/sq yd. The rafter vent 600 can be any suitable color or combination of colors. For example, the prototype dimpled rafter vent 600 had a core material color of black and a fabric backing material color of grey. The prototype dimpled rafter vent 600 has a width of 22 in, a roll length of 75 ft, a core thickness of ASTM D5199 0.50 in, a total thickness of ASTM D5261 0.51 in, and a roll area of 137.5 sq ft., a roll weight of 24 lbs., and a core openness of 90%. However, it will be apparent in view of this disclosure that in accordance with various embodiments, other thicknesses, widths, and roll lengths can be used as needed or desired.

With respect to width, in general, most rafter vents can be about 22 to 22.5 inches wide with a fabric flap extending to each side and being a minimum of 1 inch wide. Such rafter vents are suitable for trusses or roof joists spaced at 24 inches on center. In some embodiments, although potentially a less common occurrence, a rafter vent 14-to-14.5-inches wide can be provided and may be desirable in some markets in regions with higher snow loads on roofs. This is suitable for trusses or roof joists spaced at 16 inches on center. With respect to length, the rafter vents can be made in rolls as shown in FIG. 6A or in sheets/lengths. For example, in some embodiments, the rafter vents can be provided in 12 inch or longer lengths, including, for example, 48 inch lengths. However, any other size and/or width can be used in accordance with various embodiments, according to specific design needs.

With respect to material weight/density, the core ventilated mat materials and/or the fabric backing material can be as light or as dense as is sufficient to meet continuous open air space requirements while still meeting compression resistance/resilience and filtering requirements. In general, heavier, denser materials will provide superior compression resistance and (in the case of backing materials) better filtering but will provide less continuous open air space and be less compressible for storage and nesting. Conversely, lighter, less dense materials will generally provide higher continuous open air space (and thus better airflow) but will provide less compression resistance and (in the case of backing materials) less effective filtering.

The backing materials, in some embodiments, can be as light as, for example, 50 gsm, or lower. However, such light fabrics should typically be tested with a stapling trial to determine whether the fabric backing material will be strong enough to resist ripping and/or removal. In addition, the effects of spray foam installation should be tested. Alternatively, in some embodiments, a heavier backing material can be used to provide better filtering and ripping/removal resistance. In some embodiments, use of such heavier backings can permit the use of lighter/less dense core ventilation mat material to advantageously facilitate higher continuous open airflow and better overall compressibility for nesting storage. However, such configurations likely come at the cost of some overall compression resistance and may not be suitable for all applications. As noted above, in some embodiments, it is desirable to prevent any penetration by the foam into the backing fabric and/or the ventilated mat. However, in some embodiments, a small amount of penetration of the foam could be desirable to create a mechanical bond between the foam and the ventilated mat.

Referring now to FIGS. 7A-7B, in some embodiments, a flat ventilated mat 701 of a rafter vent 700 can be made with flat mat regions/bands of lighter 703 and heavier 702 core weight/filament density material to advantageously provide continuous compression resistance while also providing high continuous open air space. In such embodiments, one of more of the lighter bands 703 can be constructed of a soft, less compression-resistant material for attachment to the roof deck with a tool such as, for example, a hammer tacker. Such features can be implemented whether or not a backing fabric 704 and/or flap(s) 707 are provided. In some embodiments, such lighter bands 703 can be included proximate a center of the rafter vent 700 for added attachment support whether to supplement adhesive bonding and/or to supplement mechanical bonding along edges of the rafter vent 700 (e.g., along flaps 707).

Example Installation Processes

Referring now to FIGS. 8A-8I, installation of a rafter vent for use with batt insulation can include beginning attachment of the ventilated mat at a point located along the slope of the ceiling at an offset length L(e.g., 6-18 inches) from a centerline of a ridge vent of the roof, on a side of the roof wherein a continuous slot is cut in the roof sheathing. In some embodiments, such slots may vary from 2 to 4 inches in width.

Figure 9A:
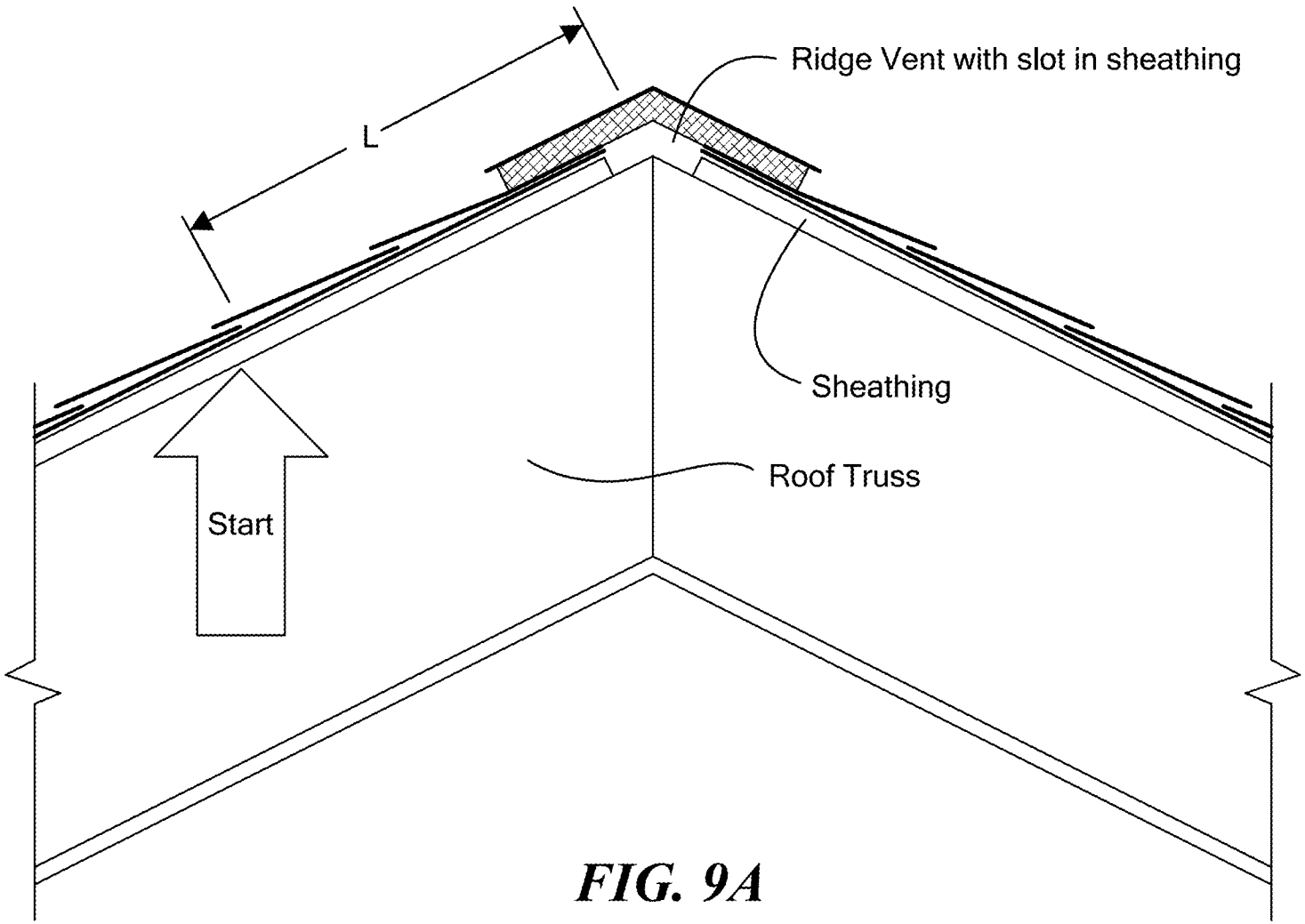
FIGS. 9A-9F illustrate method steps for installing a rafter vent in a roof for use with spray-in insulation in accordance with various embodiments.
Figure 9B:
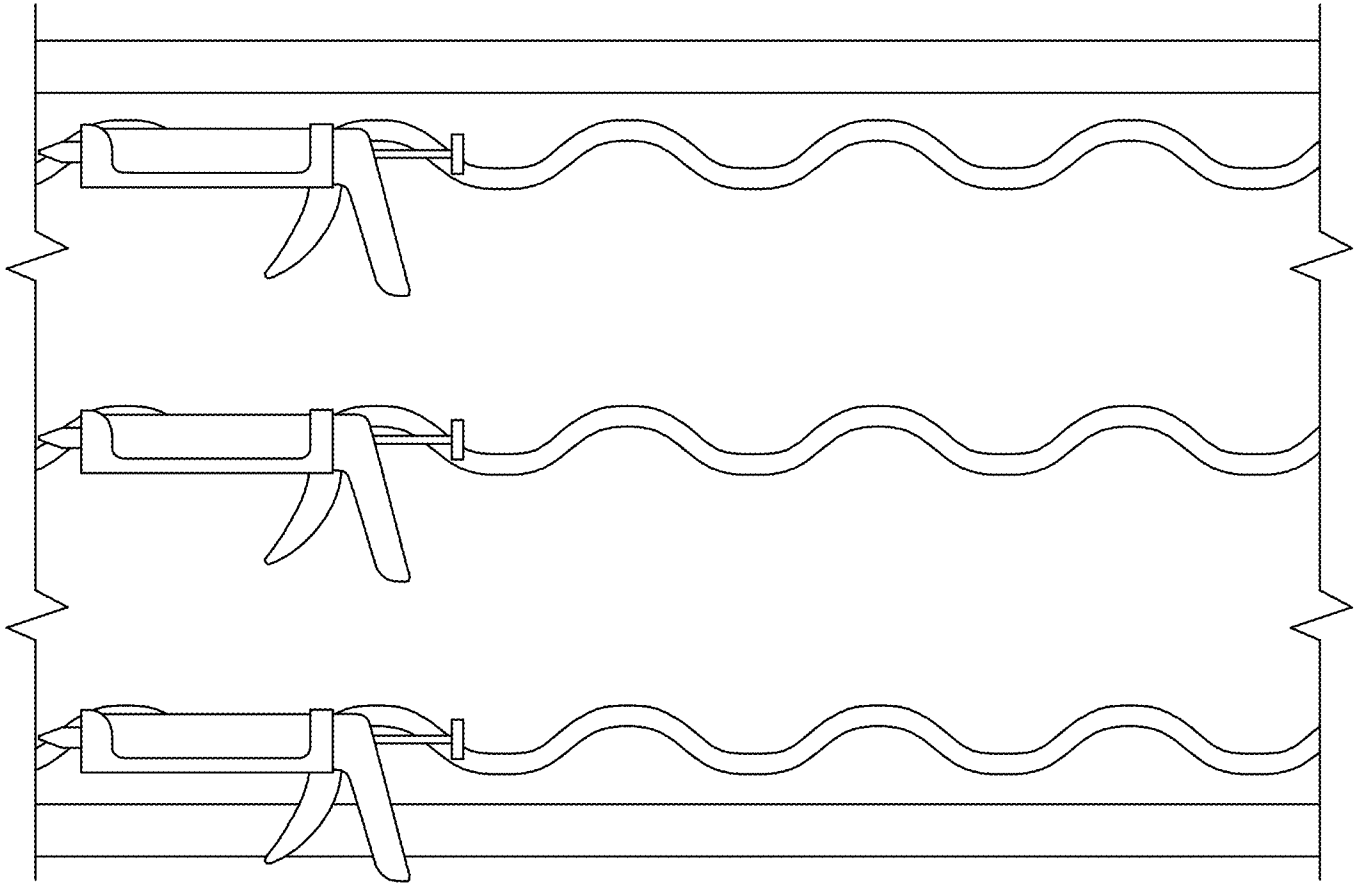
Figure 9C:
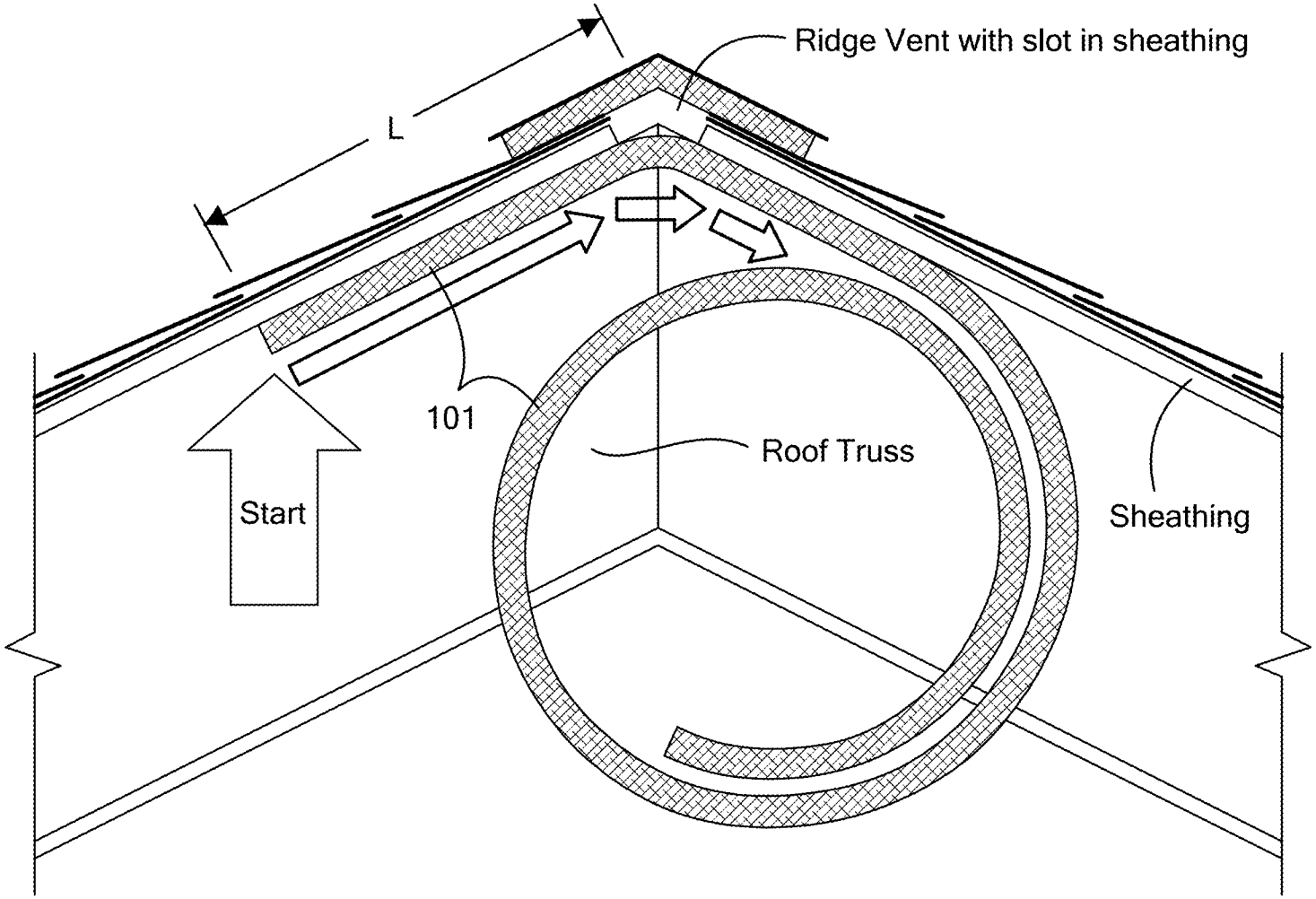
Figure 9D:
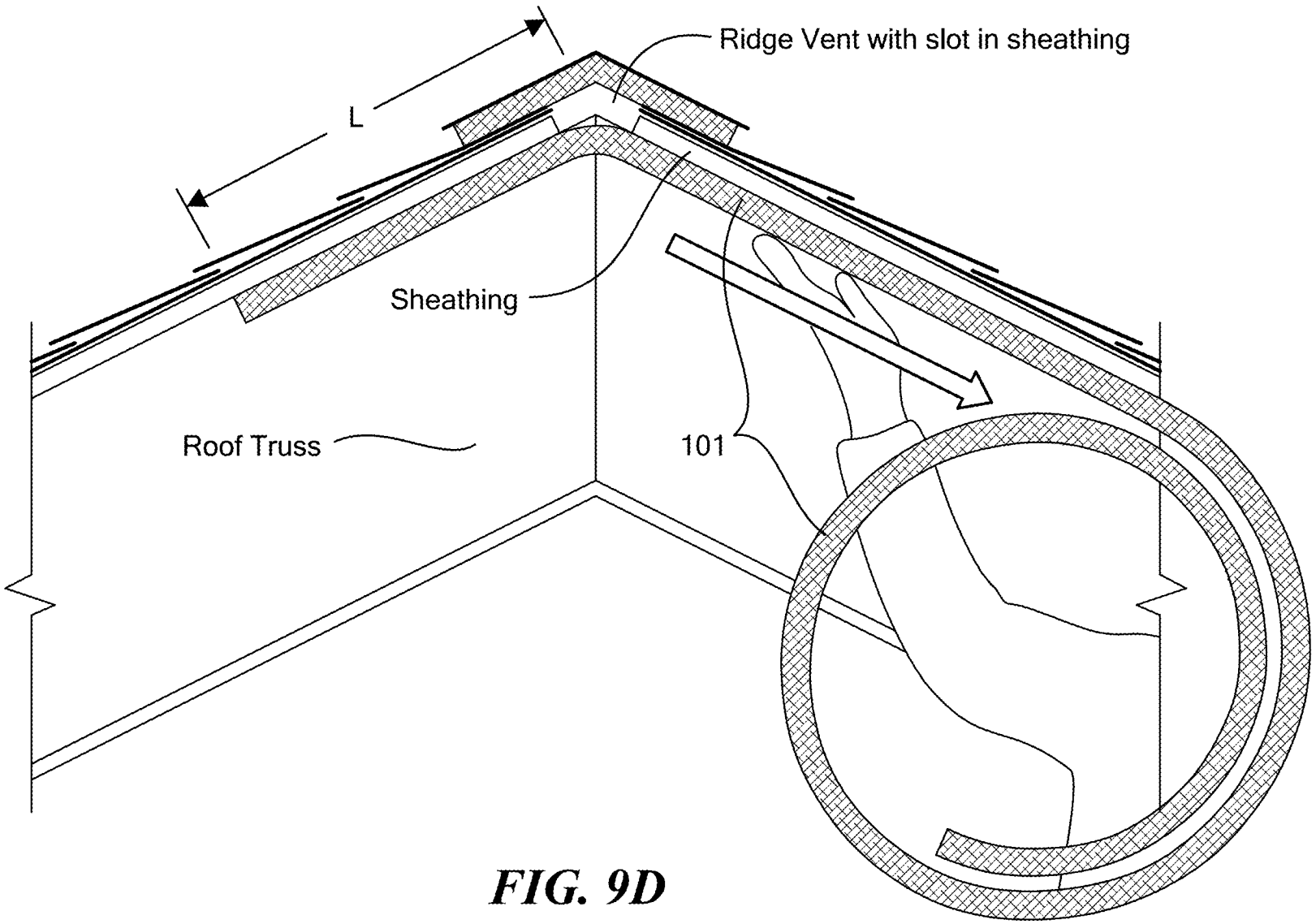
Figure 9E:
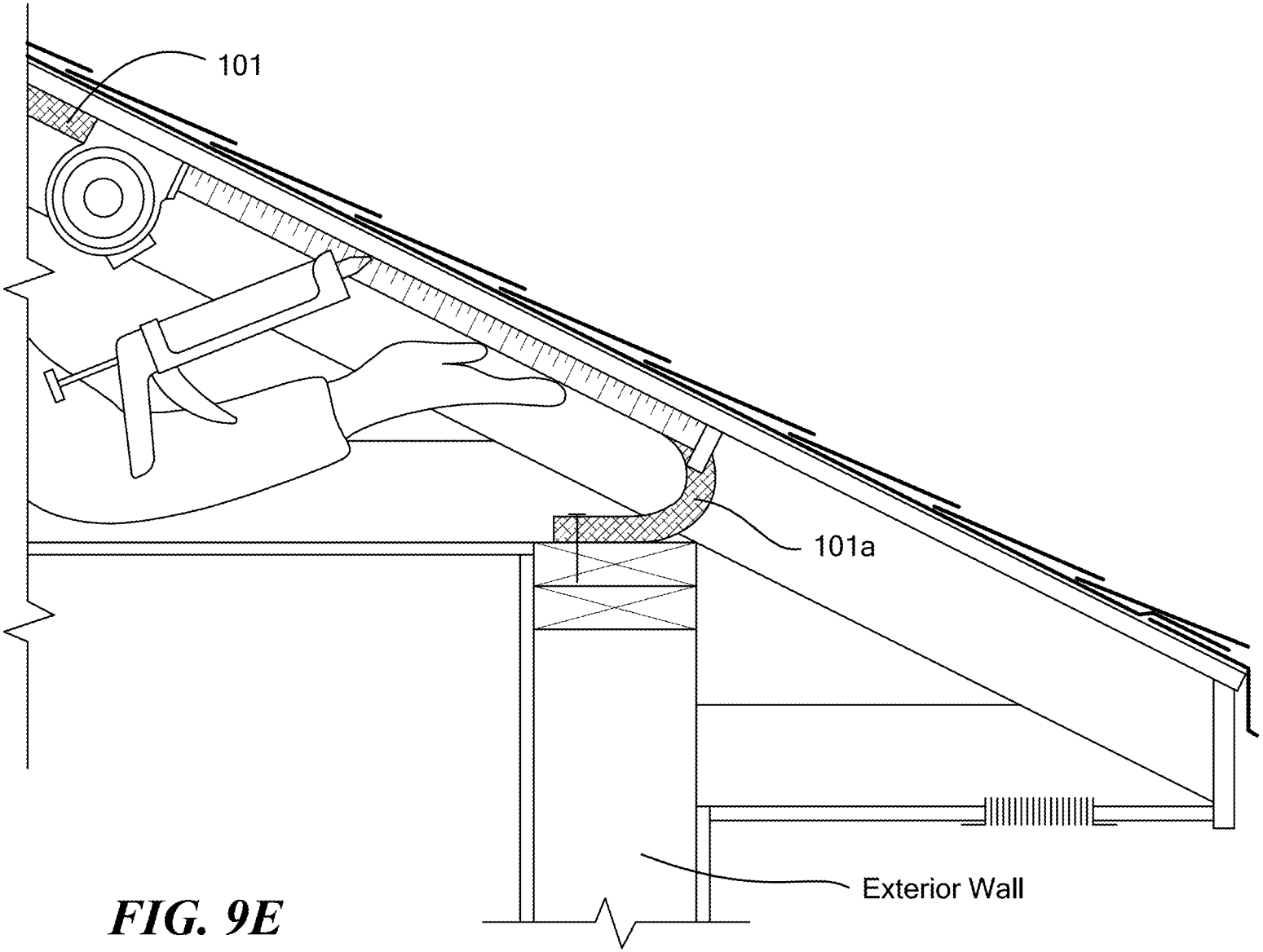
Figure 9F:
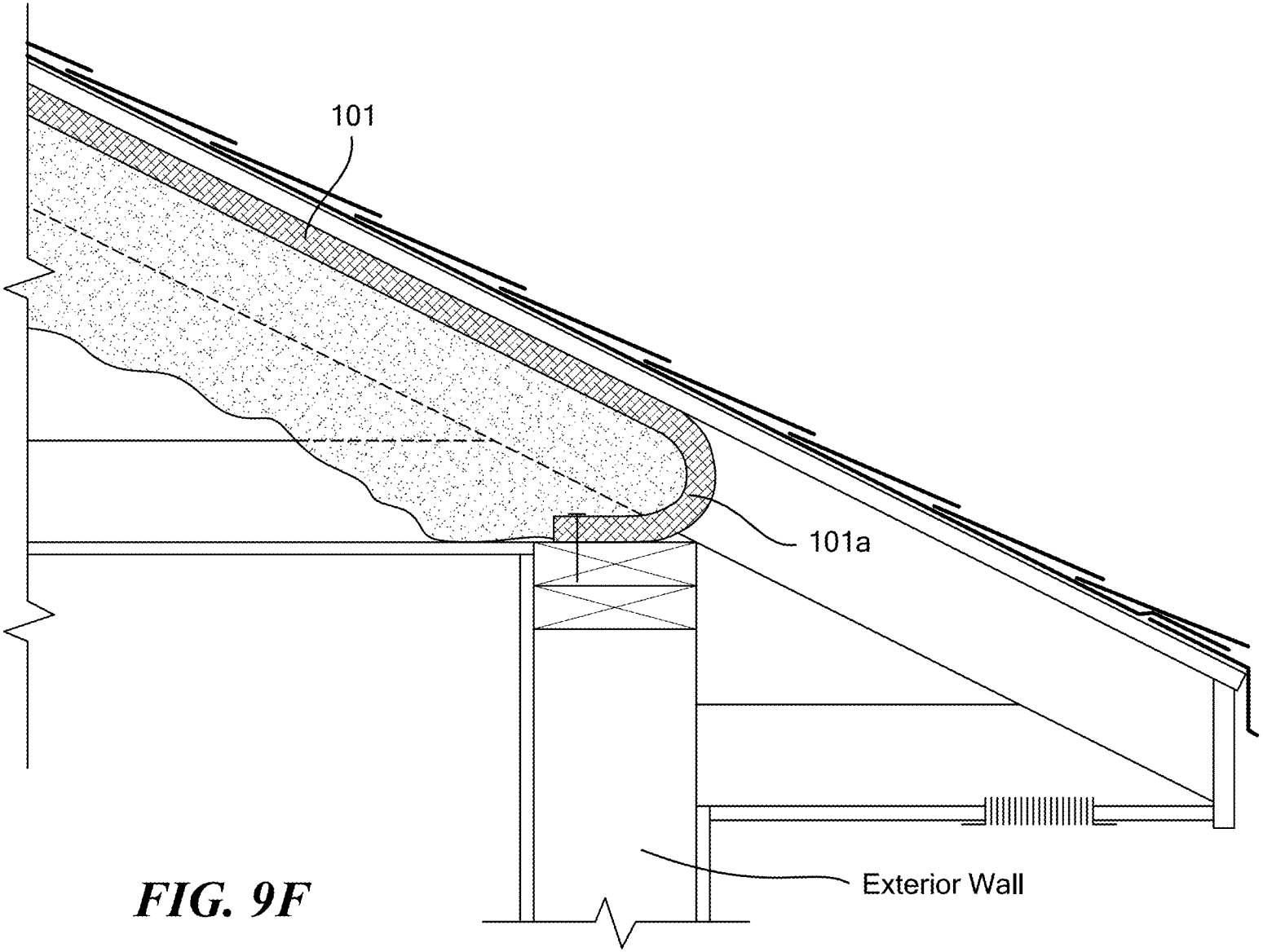

The ventilated mat can then be attached along the roof deck toward and along the side of the roof opposing the beginning attachment of the ventilated mat via one or more of chemical, thermal, or mechanical bonding thereto and/or one or more roof trusses, rafters, and/or joists. Chemical bonding is shown, for example, in FIGS. 8B, and 9B. Mechanical bonding is illustrated in FIG. 7B wherein the flaps 707 are stapled to a roof joist and one or more of the flat mat regions/bands 702, 703 are stapled to the roof deck.

To complete the first side, the ventilated mat 101 can be measured to extend a desired distance E (e.g., about 2") beyond the exterior sheathing of the roof and then cut and adhered at its end to the roof deck. Next, the ventilated mat can be butted up against the previously installed ventilated mat at the beginning point and the process can be repeated for the second side. Once both sides are completed, the batt insulation can be installed in the roof adjacent to and interior of the ventilated mat.

Referring now to FIGS. 9A-9F, installation of a rafter vent for use with spray foam insulation can include beginning attachment of the ventilated mat at a point located along the slope of the ceiling at an offset length L (e.g., 6-18 inches) from a centerline of a ridge vent of the roof, on a side of the roof wherein a continuous slot is cut in the roof sheathing. In some embodiments, such slots may vary from 2 to 4 inches in width.

The ventilated mat 101 can then be attached along the roof deck toward and along the side of the roof opposing the beginning attachment of the ventilated mat via one or more of chemical, thermal, or mechanical bonding thereto and/or one or more roof trusses, rafters, and/or joists. Chemical bonding is shown, for example, in FIGS. 8B, and 9B. Mechanical bonding is illustrated in FIG. 7B wherein the flaps 707 are stapled to a roof joist and the flat ventilated mat 701 is stapled to the roof deck (e.g., at lighter band 703).

To complete the first side, the ventilated mat 101 can be measured to extend beyond the exterior sheathing of the roof (e.g., by about 3" or more) and curve down onto a top of an exterior wall to form the integral end dam 101*a*, which can then be adhered at its end to the exterior wall by chemical, thermal, or mechanical means (e.g., by cap nail 125 as shown). Next, a second ventilated mat 101 can be butted up against the previously installed ventilated mat at the beginning point and the process can be repeated for the second side. Once both sides are completed, the foam insulation can be sprayed into the roof without collapsing or obstructing the vent.

Example Industrial Applications

Rafter vents as disclosed herein have industrial application in roofing. Examples of such applications include, although are not limited to:

- New construction using spray foam insulation under the roof deck.
- Retrofits of existing attic & roof deck structures with spray foam insulation.
- Replacement of conventional roofing ventilation systems.
- New construction or renovation of cathedral ceiling systems.
- New construction or renovation of flat ceiling systems.
- Moisture remediation in ceilings and/or roofs.

Advantages

Rafter vents as disclosed herein have several advantages over conventional roofing ventilation systems. Examples of such advantages include, but are not limited to:

- Rafter vents as disclosed herein maintain a clear air gap that cannot be closed off by insulation.
- Rafter vents as disclosed herein provide a gripping surface for spray foam to bond to.
- Rafter vents as disclosed herein provide venting and drying of condensation such that moisture is not trapped where it can cause deterioration and rot of the roof deck. This can be especially advantageous where breathable insulation is used.
- Rafter vents as disclosed herein are compatible with any form of insulation, including spray insulation and/or batt insulation.
- Rafter vents as disclosed herein provide venting for traditional cathedral ceiling applications.
- Rafter vents as disclosed herein can be used for retrofitting existing attics.
- Rafter vents as disclosed herein create a drying mechanism for incidental rainwater leaks, condensation from diffusion, air leakage, and built-in construction moisture.
- Rafter vents as disclosed herein provide a vent gap to dry out moisture sealed in by spray foam.
- Rafter vents as disclosed herein are connectable with existing or new ridge vents and soffit vents, thus facilitating the creation of a continuous vent from soffit to ridge.
- Rafter vents as disclosed herein dry water vapor caused by solar vapor drive pushing moisture into the wood deck. This is particularly advantageous when ice & water shield membranes or closed cell foam insulation trap the moisture in wood roof decks.
- Rafter vents as disclosed herein provide custom tailorable vent thicknesses by providing the option to add additional ventilated mats in a layered manner.
- Rafter vents as disclosed herein promote airflow to facilitate drying in the roof assembly.
- Rafter vents as disclosed herein can be constructed to withstand and function in extreme temperatures, both hot and cold.
- Rafter vents as disclosed herein can be constructed from recycled materials. In some embodiments, this can provide environmental benefit and/or earn the installer and/or home/building owner LEED Points.
- Rafter vents as disclosed herein are easily trimmable and/or cuttable (e.g., with any standard cutting implement such as a utility knife or scissors).
- Because the rafter vents as disclosed herein are readily cuttable to length, width, and/or shape, the rafter vents simplify installation from rolled rafter vent materials, adapt to different joist widths, and simplify customization for non-standard special conditions.

What is claimed is:

1. A rafter vent, comprising:

a ventilated mat configured to be installed between adjacent roof joists of a roof structure, the ventilated mat having a length of at least 48 inches and a width of either (i) 14 to 14.5 inches, to allow the ventilated mat to be positioned between roof joists spaced at 16 inches on center, or (ii) 22 to 22.5 inches, to allow the ventilated mat to be positioned between roof joists spaced at 24 inches on center, the ventilated mat comprising a plurality of entangled filaments; and a backing adhered to a first surface of the ventilated mat, the first surface being oriented to face away from a roof deck attached to the adjacent roof joists when the ventilated mat is installed between the adjacent roof joists, wherein portions of the backing extend beyond parallel sides of the ventilated mat to form flaps that facilitate attachment of the rafter vent to the adjacent roof joists between which the rafter vent is to be installed.

2. The rafter vent of claim 1, wherein the ventilated mat is positioned underneath the roof deck and between the adjacent roof joists, and the first surface faces away from the roof deck.

3. The rafter vent of claim 2, wherein the plurality of entangled filaments include at least one of polypropylene, nylon six, or combinations thereof.

4. The rafter vent of claim 1, wherein the ventilated mat is at least one of a sheet of material, a roll of material, or a batt.

5. The rafter vent of claim 1, wherein the ventilated mat includes one or more surface features on a second surface, opposite the first surface, the one or more surface features include at least one of dimples, channels, waffles, or combinations thereof.

6. The rafter vent of claim 5, wherein at least a portion of the second surface having the one or more surface features is flat, the portion having a thickness less than a feature thickness of the one or more surface features.

7. The rafter vent of claim 1, wherein an entire second surface of the ventilated mat, opposite the first surface, is flat.

8. The rafter vent of claim 1, wherein the ventilated mat includes:

a first band comprising a first entangled filament material having a first fiber density; and a second band comprising a second entangled filament material having a second fiber density less than the first fiber density.

9. The rafter vent of claim 8, wherein the ventilated mat comprises a first plurality of bands of the first entangled filament material and a second plurality of bands of the second entangled filament material, the first plurality of bands of the first entangled filament material and the second plurality of bands of the second entangled filament material arranged in an alternating configuration along at least one of the length or the width of the ventilated mat.

10. The rafter vent of claim 1, wherein the backing is a filter fabric.

11. The rafter vent of claim 1, wherein the ventilated mat has a thickness of at least 0.375 inches.

12. The rafter vent of claim 1, wherein the rafter vent is rolled along its length into a spiral configuration.

13. A rafter vent installed within a roof structure of a building, the roof structure including adjacent roof joists and a roof deck attached to the adjacent roof joists, the rafter vent comprising:

a ventilated mat positioned underneath the roof deck and between the adjacent roof joists, the ventilated mat comprising a plurality of entangled filaments and having a first surface;

a backing having a second surface and a third surface opposite the second surface, the second surface being adhered to the first surface of the ventilated mat such that the third surface faces away from the roof deck; and spray foam insulation adhered to the third surface of the backing.

14. The rafter vent of claim 13, wherein the adjacent roof joists are spaced at 16 inches on center and the ventilated mat has a width of 14 to 14.5 inches.

15. The rafter vent of claim 13, wherein the adjacent roof joists are spaced at 24 inches on center and the ventilated mat has a width of 22 to 22.5 inches.

16. The rafter vent of claim 13, wherein the ventilated mat has a thickness of at least 0.375 inches.

17. The rafter vent of claim 13, wherein:

portions of the backing extend beyond parallel sides of the ventilated mat to form flaps that are attached to the adjacent roof joists.

18. The rafter vent of claim 13, further comprising:

a filter fabric backing adhered to a first surface of the ventilated mat, the first surface facing away from the roof deck.

19. The rafter vent of claim 13, wherein an end of the rafter vent is curved downward and attached to a top of a side exterior wall of the building to form an integral dam.

20. The rafter vent of claim 13, wherein the roof structure is a cathedral ceiling.

* * * * *